US008794729B2

(12) United States Patent
Ushiyama et al.

(10) Patent No.: US 8,794,729 B2
(45) Date of Patent: Aug. 5, 2014

(54) IMAGE RECORDING APPARATUS, IMAGE RECORDING METHOD, AND DATA GENERATION APPARATUS

(71) Applicant: Canon Kabushiki Kaisha, Tokyo (JP)

(72) Inventors: Takayuki Ushiyama, Kawasaki (JP); Yoshitomo Marumoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/911,989

(22) Filed: Jun. 6, 2013

(65) Prior Publication Data

US 2013/0328962 A1 Dec. 12, 2013

(30) Foreign Application Priority Data

Jun. 8, 2012 (JP) ..... 2012-131301

(51) Int. Cl.

| | |
|---|---|
| ***B41J 2/205*** | (2006.01) |
| ***B41J 2/045*** | (2006.01) |
| ***B41J 2/21*** | (2006.01) |
| *B41J 11/00* | (2006.01) |

(52) U.S. Cl.

CPC ..... *B41J 2/0454* (2013.01); *B41J 2/2135* (2013.01); *B41J 11/002* (2013.01)

USPC ..... 347/15

(58) Field of Classification Search

CPC ..... B41J 11/002; B41J 2/0454; B41J 2/2135
USPC ..... 347/9, 12, 14–17; 358/1.8
See application file for complete search history.

(56) References Cited

U.S. PATENT DOCUMENTS

| | | | | |
|---|---|---|---|---|
| 8,157,343 | B2 * | 4/2012 | Marumoto | 347/14 |
| 8,328,329 | B2 * | 12/2012 | Marumoto et al. | 347/41 |
| 2011/0090518 | A1 | 4/2011 | Marumoto | |

FOREIGN PATENT DOCUMENTS

| | | | |
|---|---|---|---|
| JP | H01-113249 | A | 5/1989 |
| JP | 2006-44258 | A | 2/2006 |

* cited by examiner

*Primary Examiner* — An Do
(74) *Attorney, Agent, or Firm* — Canon USA Inc IP Division

(57) ABSTRACT

In a mask pattern that determines whether ink is to be discharged and recorded for each pixel, a distance between recording permitting pixels at a portion employed for recording nozzles corresponding to a region where the temperature of a recording medium is relatively low after ink droplets are applied is set to be longer than a distance between recording permitting pixels at a portion employed for a recording region corresponding to a region on the recording medium other than the above-described region.

20 Claims, 18 Drawing Sheets

FIG. 17

| TEMPERATURE (°C) OF RECORDING SURFACE WHEN PREDETERMINED TIME HAS ELAPSED AFTER RECORDING | OVERALL AVERAGE OF DISTANCES BETWEEN MOST CLOSELY ADJACENT CLUSTERS |
|---|---|
| 60°C OR HIGHER | 1 OR LONGER |
| 50~60 | 2 OR LONGER |
| 40~50 | 4 OR LONGER |
| LOWER THAN 40°C | 6 OR LONGER |

IMAGE RECORDING APPARATUS, IMAGE RECORDING METHOD, AND DATA GENERATION APPARATUS

BACKGROUND OF THE INVENTION

1. Field of the Invention

The present invention relates to an image recording apparatus, an image recording method, and a data generation apparatus.

2. Description of the Related Art

There are known image recording apparatuses that record an image by repeatedly performing recording scanning and sub-scanning. In the recording scanning, the image forming apparatuses discharge ink while relatively moving a discharge head, on which a plurality of recording nozzles configured to discharge the ink is arranged, relative to a unit region on a recording medium. In the sub-scanning, the image forming apparatuses convey the recording medium in a sub-scanning direction, which is a direction intersecting with a recording scanning direction. As a recording method employed by theses image forming apparatuses, there is known a recording method for forming an image by performing recording scanning a plurality of times on a unit region with use of data generated by dividing data of an image to be formed on the unit region according to a mask pattern in which recording permitting pixels permitted to record dots during each scanning are arranged.

In recent years, in the field of inkjet recording, users have been demanding a higher image quality for a recorded image, and have been demanding a recorded image with a low grainy effect. In addition to these demands, the users have been demanding a recording process capable of fixing a color material in ink onto a recording medium with a poor chemical affinity for the ink to deal with an expansion in the range of types of used inks and recording media.

As an example of a method for reducing the degree or frequency of beading between applied ink droplets at the recording apparatuses that record an image by performing scanning a plurality of times on a unit region on a recording medium, Japanese Patent Application Laid-Open No. 2006-44258 discusses the following technique. According to this technique, an image recording apparatus determines a layout of recording permitting pixels in a mask pattern with use of repulsive potentials provided to pixels with dots arranged thereon, and dispersively arranges dots so as to avoid beading between ink droplets applied on a recording medium at an intermediate stage during image formation.

On the other hand, Japanese Patent Application Laid-Open No. 1-113249 discusses a method for fixing a color material contained in ink onto a recording medium by applying heat to the ink with use of a heating unit when the ink is applied onto the recording medium. This method promotes fixation of the color material by promptly evaporating moisture contained in the ink.

However, as a result of consideration, the inventors have discovered the following problem; if ink is discharged onto a recording medium maintained at a relatively high temperature, density unevenness and a visually noticeable grainy effect occur in an image formed on a certain region on the recording medium depending on the type of the recording medium.

In the following description, this problem will be described based on an example of an image recording apparatus configured to heat a recording medium.

FIG. 1 is a schematic view illustrating how ink droplets act when the ink droplets are applied onto a heated recording medium, at the time of recording using an image forming apparatus provided with a heating unit.

As illustrated in part (a) in FIG. 1, ink is discharged from a discharge head that scans a recording medium in a main scanning direction indicated by an arrow in FIG. 1. The recording medium is heated by a heater from a position opposite the recording medium. The recording medium with the ink applied thereon is conveyed in the sub-scanning direction indicated by an arrow in FIG. 1.

Part (b) in FIG. 1 illustrates a change in heat distribution on the recording medium between before and after the application of the ink, indicating the changing state as viewed in cross-section perpendicular to the recording medium along the sub-scanning direction illustrated in part (a) in FIG. 1. With the passing of time from a state b1, the state shifts to states b2, b3, b4, and b5. Immediately before the application of the ink (the state b1), a heated region (indicated by white arrows) is wider than a region of the recording medium where an image is formed by one scanning operation by the discharge head (a scanning region (a region C in part (b) in FIG. 1)). Therefore, the recording medium has high-temperature and even heat distribution over a range wider than one scanning region. For example, if the recording medium is made from, for example, a vinyl compound, the heat conductivity should be high, whereby it is considered that the recording medium has high-temperature and even heat distribution over a wide range.

It should be noted that not only the heat directly supplied from the heating unit but also heat supplied from the heated recording medium are used for evaporation of moisture in the ink when the ink is applied onto the one scanning region of the recording medium. Therefore, during a short period immediately after the application of the ink, the temperature reduces at portions of the recording medium where the ink 27 is applied (the state b2).

On the other hand, because moisture is not evaporated on a region of the recording medium outside the one scanning region C (a non-image forming region), this region is not subject to such a reduction in the stored heat.

Therefore, regarding an end region (A) of the one scanning region in the sub-scanning direction, the non-image forming region exists near the region (A), whereby the heat stored in the non-image forming region is transmitted to the region (A) via the recording medium, and, therefore, the lost heat can be relatively easily compensated for (the state b3).

However, regarding a central portion of the one scanning region in the sub-scanning direction, there is no non-image forming region near the central portion, whereby a heat recovery is relatively slow here compared to the end portion.

As a result, during a period of a certain time after the application of the ink, such as a period from the state b3 to the state b4, the recording medium has such temperature unevenness within the one scanning region thereof that the temperature at the central portion is lower than the temperature at the end portion in the sub-scanning direction.

If the temperature unevenness occurs, it takes a longer time to evaporate moisture in the ink at the low-temperature portion, increasing a time to fix the ink onto the recording medium compared to the high-temperature portion. Therefore, the low-temperature portion has a larger number of opportunities for a plurality of applied ink droplets to move and then contact one another before the fixation compared to the high-temperature portion, and is subject to easy displacement of the ink droplets when they contact one another compared to the high-temperature portion. This situation facilitates occurrence of beading, leading to a possibility of development of density unevenness and deterioration of a grainy effect in a recorded image.

One possible method against this problem is to supply a large heat amount from the heating unit to eliminate the above-described low-temperature portion from the recording medium, but this method may result in an increase in the size of the heating unit and complexity of the mechanism of the recording apparatus.

As described above, the inventors of the present invention have discovered the new problem of an image quality being affected by temperature distribution of a recording medium when ink droplets are applied onto the recording medium.

SUMMARY OF THE INVENTION

The present invention is directed to an image recording method capable of recording a high-quality image by preventing occurrence of density unevenness and a grainy effect in a recorded image, and an apparatus capable of performing this method.

According to an aspect of the present invention, an image recording apparatus configured to record an image by discharging ink onto a recording medium based on recording data includes a discharge head including a discharge port array in which a plurality of discharge ports configured to discharge the ink is arranged in an arrangement direction, a heating unit configured to heat the recording medium, a scanning unit configured to cause the discharge head to relatively scan a unit region on the recording medium a plurality of times in a scanning direction intersecting with the arrangement direction in such a manner that respective different divided portions, among a plurality of divided portions formed by dividing the discharge port array, face the unit region by the respective plurality of times of scanning, and a generation unit configured to generate recording data to be used in the respective times of scanning of the discharge head on the unit region by employing a divided pattern, which corresponds to each of the different portions of the discharge port array and includes an arrangement of recording permitting pixels that determine permission of recording onto the unit region and recording non-permitting pixels that determine nonpermission of recording onto the unit region, for image data corresponding to the unit region, wherein an average of distances between each of the recording permitting pixels and the recording permitting pixel located at a close position thereto in the divided pattern corresponding to a region that has a first temperature when the discharged ink is applied onto the recording medium is longer than an average of distances between each of the recording permitting pixels and the recording permitting pixel located at a close position thereto in the divided pattern corresponding to a region that has a second temperature higher than the first temperature when the discharged ink is applied onto the recording medium.

Further features of the present invention will become apparent from the following description of exemplary embodiments with reference to the attached drawings.

BRIEF DESCRIPTION OF THE DRAWINGS

FIG. 17 illustrates a relationship between a temperature and the distance between the recording permitting pixel set units according to the third exemplary embodiment of the present invention.

DESCRIPTION OF THE EMBODIMENTS

Hereinafter, a first exemplary embodiment of the present invention will be described in detail.

Figure 1:
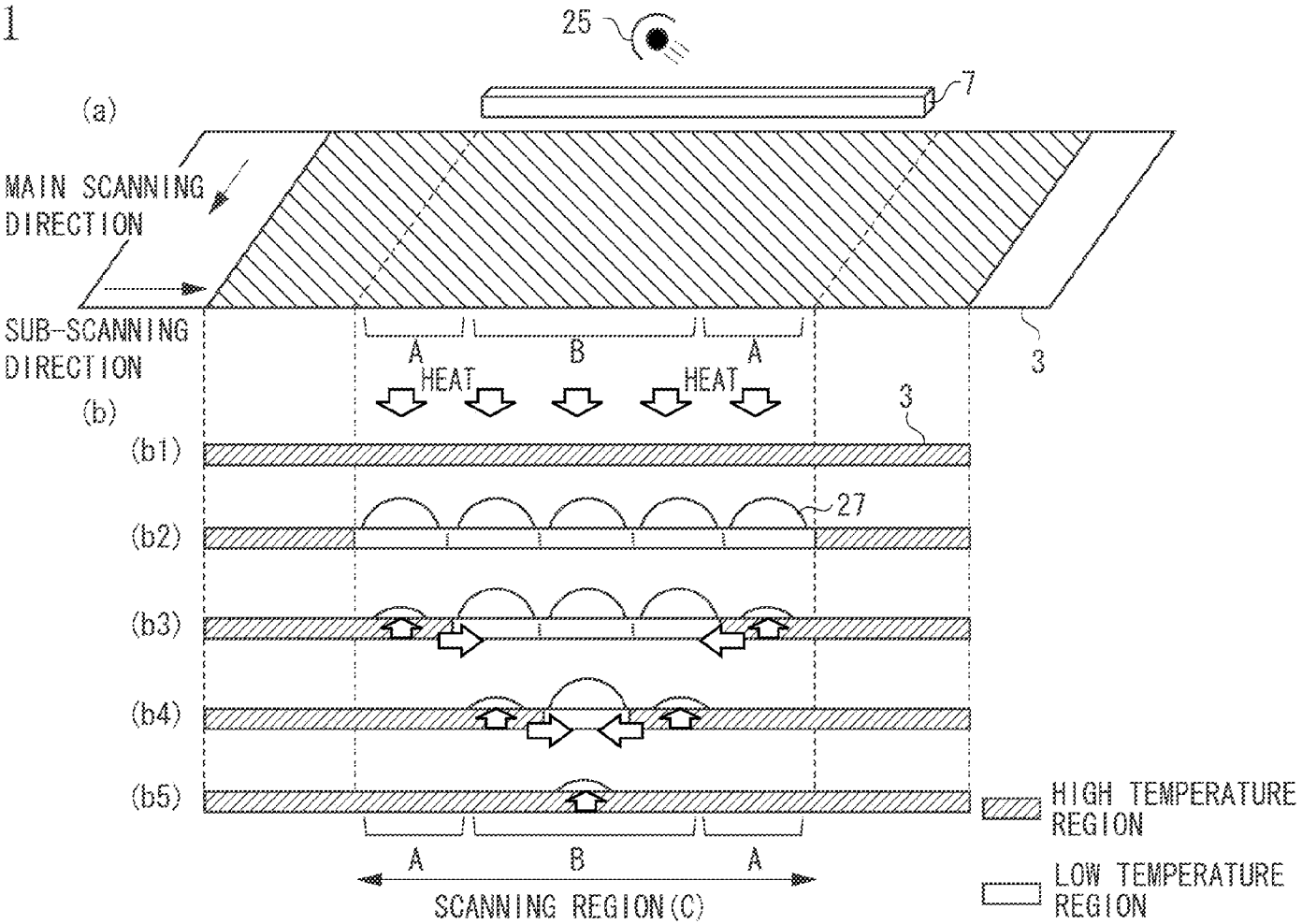
FIG. 1 illustrates how heat is transmitted when an image is formed while a recording medium is heated.
Figure 2:
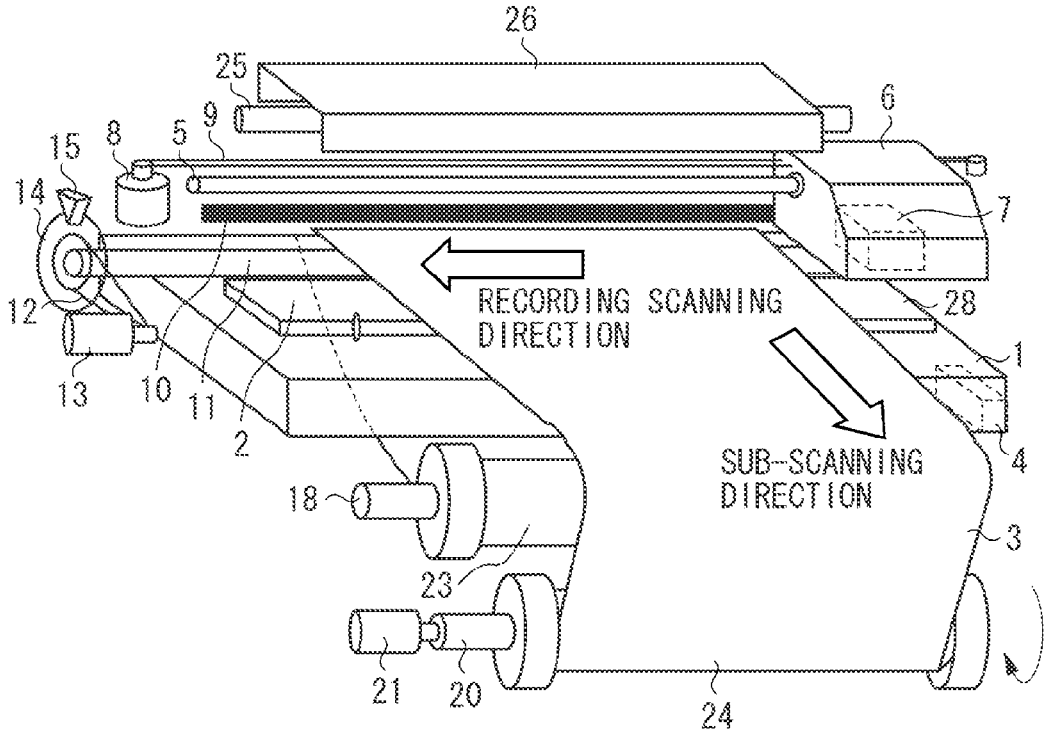
FIG. 2 is a perspective view illustrating a recording apparatus employed in an exemplary embodiment of the present invention.
Figure 3:
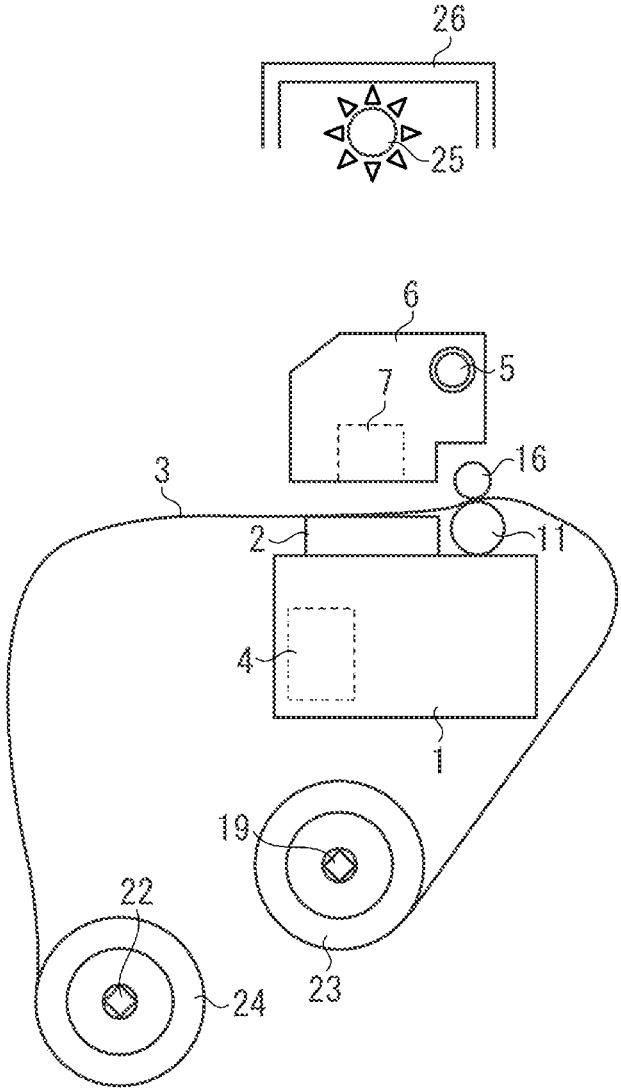
FIG. 3 is a side view illustrating an internal mechanism of the recording apparatus employed in the exemplary embodiment of the present invention.

FIG. 2 is a perspective view partially illustrating a configuration of an inkjet recording apparatus according to an exemplary embodiment of the present invention. FIG. 3 is a side view partially illustrating the configuration of the inkjet recording apparatus according to the exemplary embodiment of the present invention.

A casing 1 is disposed within the inkjet recording apparatus. A platen 2 is disposed on the casing 1. Further, a suction device 4 is disposed in the casing 1. The suction device 4 functions to attract a sheet-like recording medium 3 to the platen 2. Further, a carriage 6 reciprocably movable in a recording scanning direction is supported by a main rail 5 disposed along a longitudinal direction of the casing 1. An inkjet-type discharge head 7 is mounted on the carriage 6. Various types of inkjet methods, such as a method using heating elements and a method using piezoelectric elements, can be used for the discharge head 7. A carriage motor 8 is a drive source for moving the carriage 6 in the recording scanning direction, and a rotational driving force thereof is transmitted to the carriage 6 via a belt 9. The position of the carriage 6 in the recording scanning direction is detected and monitored by a linear encoder. The linear encoder includes a linear encoder pattern 10 attached to the casing 1, and a reading unit (not illustrated in FIG. 2) mounted on the carriage 6, which reads the encoder pattern 10 optically, magnetically, or mechanically.

The recording medium 3 is fed from a roll paper feeding medium 23 provided around a paper feeding spool 18. Various kinds of media can be used as the recording medium 3. However, it may be convenient to use a medium that does not absorb water or absorbs little water in consideration of an outdoor exhibition of a recorded product. Examples of such media include a medium with a recording surface thereof made of a low water-absorption resin such as a vinyl chloride sheet. The paper feeding spool 18 includes a torque limiter 19 for applying a brake force to the recording medium 3. The recording medium 3 is conveyed on the platen 2 in a sub-scanning direction perpendicular to the recording scanning direction (a main scanning direction) of the carriage 6 (both directions are indicated by arrows in FIG. 2). This conveyance is performed by a driving mechanism that includes a conveyance roller 11, a pinch roller 16, a belt 12, and a conveyance motor 13. The driving state (the rotational amount and the rotational speed) of the conveyance roller 11 is detected and monitored by a rotary encoder. The rotary encoder includes an circular encoder pattern 14 configured to rotate together with the conveyance roller 11, and a reading unit 15 configured to read the encoder pattern 14 optically, magnetically, or mechanically. After an image is printed on the recording medium 3 by the discharge head 7, the recording medium 3 is wound up by a winding spool 20 to form a roll wound medium 24. The winding spool 20 rotates by a winding motor 21, and includes a torque limiter 22 for applying winding tension to the recording medium 3.

In the present exemplary embodiment, a color material in liquid ink is fixed onto the recording medium 3 by heat from a heater 25 located at a position opposite the platen 2 and supported by a not-illustrated frame.

The heater 25 is covered by a heater cover 26, and the heater cover 26 has a function of efficiently transmitting heat of each heater element to a paper surface, and a function of protecting the heater 25. The heater 25 is positioned right above a surface to be printed, and the recording medium 3 has been already evenly heated when the ink is discharged from the discharge head 7. Therefore, the ink, which is an example of liquid discharged from the discharge head 7, is fixed by the heat from the heater 25 and heat from the heated recording medium 3 from immediately after application of the ink onto the surface to be printed.

At the stage that the recording medium 3 receives the heat from the heater 25, the ink does not have to be completely fixed onto the recording medium 3. It is enough that the recording medium 3 is heated to such a degree that the viscosity increases to some degree and the ink on the recording medium 3 has lower fluidity.

Figure 4:
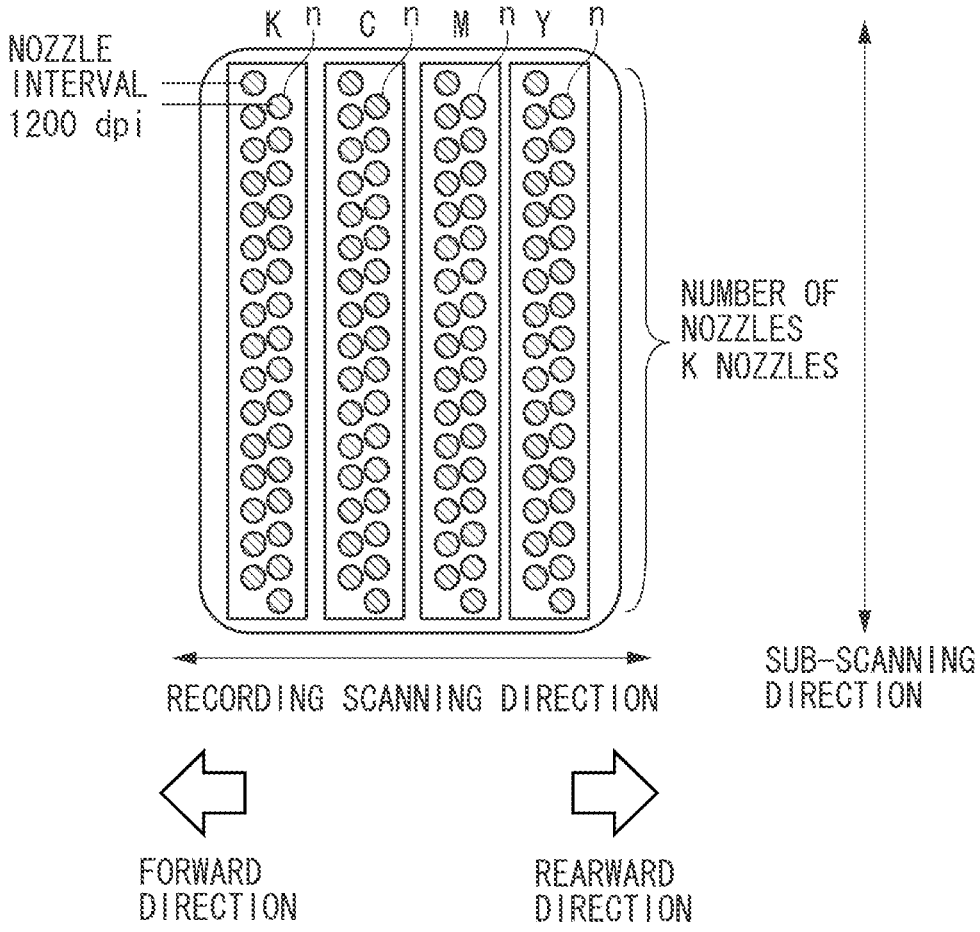
FIG. 4 illustrates recording nozzles disposed on a discharge head employed in the exemplary embodiment of the present invention.

FIG. 4 is a plan view schematically and briefly illustrating a layout of nozzles n of the discharge head 7 used in the exemplary embodiment of the present invention. A plurality of nozzles n configured to discharge the ink is disposed at the discharge head 7 illustrated in FIG. 4. Each of the nozzles n includes a discharge port, from which the ink is discharged, and an ink flow passage (not illustrated in FIG. 4), which is in communication with the discharge port. An electrothermal converter is disposed in the ink flow passage of each of the nozzles n. The electrothermal converter locally heats the ink to bring about film boiling, and causes the ink to be discharged with use of blowing energy therefrom. Nozzle arrays respectively corresponding to inks of a plurality of used colors are arranged at the discharge head 7. Each nozzle array in the present exemplary embodiment includes k nozzles n arranged at a density of 1200 dpi along the sub-scanning direction, which is a direction in which the recording medium 3 is conveyed.

The discharge head 7 in the present exemplary embodiment is a lateral configuration head, in which nozzle arrays configured to discharge inks of black (Bk), cyan (C), magenta (M), and yellow (Y) are sequentially arranged along the recording scanning direction for enabling recording of a full color image.

At the inkjet recording apparatus configured in this manner, the recording medium 3 is conveyed from a conveyance unit (not illustrated in FIG. 4) in the sub-scanning direction. The discharge head 7 receives a recording signal from a recording control unit (not illustrated in FIG. 4), and discharges the ink toward a recording region of the recording medium 3 while moving together with the carriage 6 in the recording scanning direction. The inkjet recording apparatus repeats such a recording operation and a conveyance operation for conveying the recording medium 3 in the sub-scanning direction by a predetermined distance.

With the predetermined distance set to a distance shorter than the length of the array of the discharge ports, the discharge head 7 discharges the ink a plurality of times while changing the range of the array of the discharge ports arranged on the discharge head 7, which is used for a unit region on the recording medium 3 on the recording apparatus, thereby recording an image on the recording medium 3 during recording scanning.

All of the inks used in the present exemplary embodiment contain a resin emulsion. In the present exemplary embodiment, the term "resin emulsion" refers to polymer fine particles that exist dispersively in water. Specific examples thereof include an acrylic emulsion synthesized by emulsion polymerization or the like of monomers such as (meth)acrylic acid alkyl ester and (meth)acrylic acid alkyl amide; a styrene-acryl emulsion synthesized by emulsion polymerization or the like of (meth)acrylic acid alkyl ester, (meth)acrylic acid alkyl amide, or the like, and a styrene monomer; a polyethylene emulsion; a polypropylene emulsion; polyurethane emulsion; and a styrene-butadiene emulsion. Further, the resin emulsion may be, for example, a core-shell type resin emulsion, in which the composition of polymers is different between a core portion and a shell portion constituting the resin emulsion, and an emulsion produced by using acrylic fine particles synthesized in advance to control the particle diameter as seed particles, and performing emulsion polymerization around the seed particles. Further, the resin emulsion may be, for example, a hybrid type resin emulsion produced by chemically bonding different resin emulsions, such as an acrylic resin emulsion and a urethane resin emulsion.

Examples of monomers constituting the resin emulsion include (meth)acrylic acid; (meth)acrylic acid alkyl ester synthesized from alkyl alcohol such as methyl(meth)acrylate, n-butyl(meth)acrylate, and 2-ethylhexyl(meth)acrylate, and (meth)acrylic acid; and (meth)acrylic acid alkylamide such as (meth)acrylamide, dimethyl(meth)acrylamide, N,N-dimethylethyl(meth)acrylamide, N,N-dimethylpropyl(meth)acrylamide, isopropyl(meth)acrylamide, diethyl(meth)acrylamide, and (meth)acryloyl morpholine.

Regarding the molecular weight of the resin emulsion used in the ink according to the present exemplary embodiment, the number-average molecular weight (Mn) in terms of polystyrene standard measured by gel permeation chromatography (GPC) can be 100,000 or more and 3,000,000 or less, and further, can be 300,000 or more and 2,000,000 or less.

The average particle diameter of the resin emulsion used in the ink according to the present exemplary embodiment can be 50 nm or more and 250 nm or less. An average particle diameter less than 50 nm results in an increase in the surface area of the resin emulsion particles per unit volume, and, therefore, results in an increase in the cohesive force between the particles, leading to a possibility of being unable to sufficiently acquire an effect of improving the storage stability. Further, an average particle diameter more than 250 nm results in acceleration of the sedimentation velocity of the resin emulsion in the ink, leading to a possibility of being unable to sufficiently acquire an effect of improving the discharge stability and the storage stability of the ink.

The glass transition temperature (Tg) of the resin emulsion used in the ink according to the present exemplary embodiment can be 40° C. or higher and 90° C. or lower, and further, can be 50° C. or higher and 80° C. or lower. A glass transition temperature Tg lower than 40° C. results in a soft resin, leading to a possibility of being unable to sufficiently acquiring an effect of improving the abrasion resistance of an acquired image. Further, a glass transition temperature Tg higher than 90° C. results in an increase in the minimum film formation temperature of the resin emulsion, leading to a possibility of hindering easy softening of the resin applied on the recording medium 3 and, therefore, insufficient fixability of an image. From these points of view, the resin emulsion can be a resin emulsion using methyl(meth)acrylate, n-butyl (meth)acrylate, or 2-ethylhexyl(meth)acrylate, from which the glass transition temperature Tg of the acquired resin emulsion falls within the range of 40° C. or higher and 90° C. or lower.

The contained amount (percent by mass) of the resin emulsion used in the ink according to the present exemplary embodiment can be 0.1 percent by mass or more and 10.0 percent by mass or less, and further, can be 2.0 percent by mass or more and 8.0 percent by mass or less relative to a total mass of the ink. A contained amount less than 0.1 percent by mass may lead to an inability to sufficiently acquire an effect of improving the abrasion resistance of an image. Further, a contained amount more than 10.0 percent by mass may result in an increase in the viscosity of the ink, leading to a possibility of being unable to sufficiently acquire an effect of improving the discharge stability of the ink.

The present exemplary embodiment uses a sheet with a layer of vinyl chloride formed on a base material as the recording medium 3. The recording medium 3 employed in the present exemplary embodiment is not limited to the sheet made from vinyl chloride, but the present exemplary embodiment can become remarkably effective, especially when the recording medium 3 is embodied by a recording medium that absorbs little ink or a recording medium that does not absorb ink.

Figure 5:
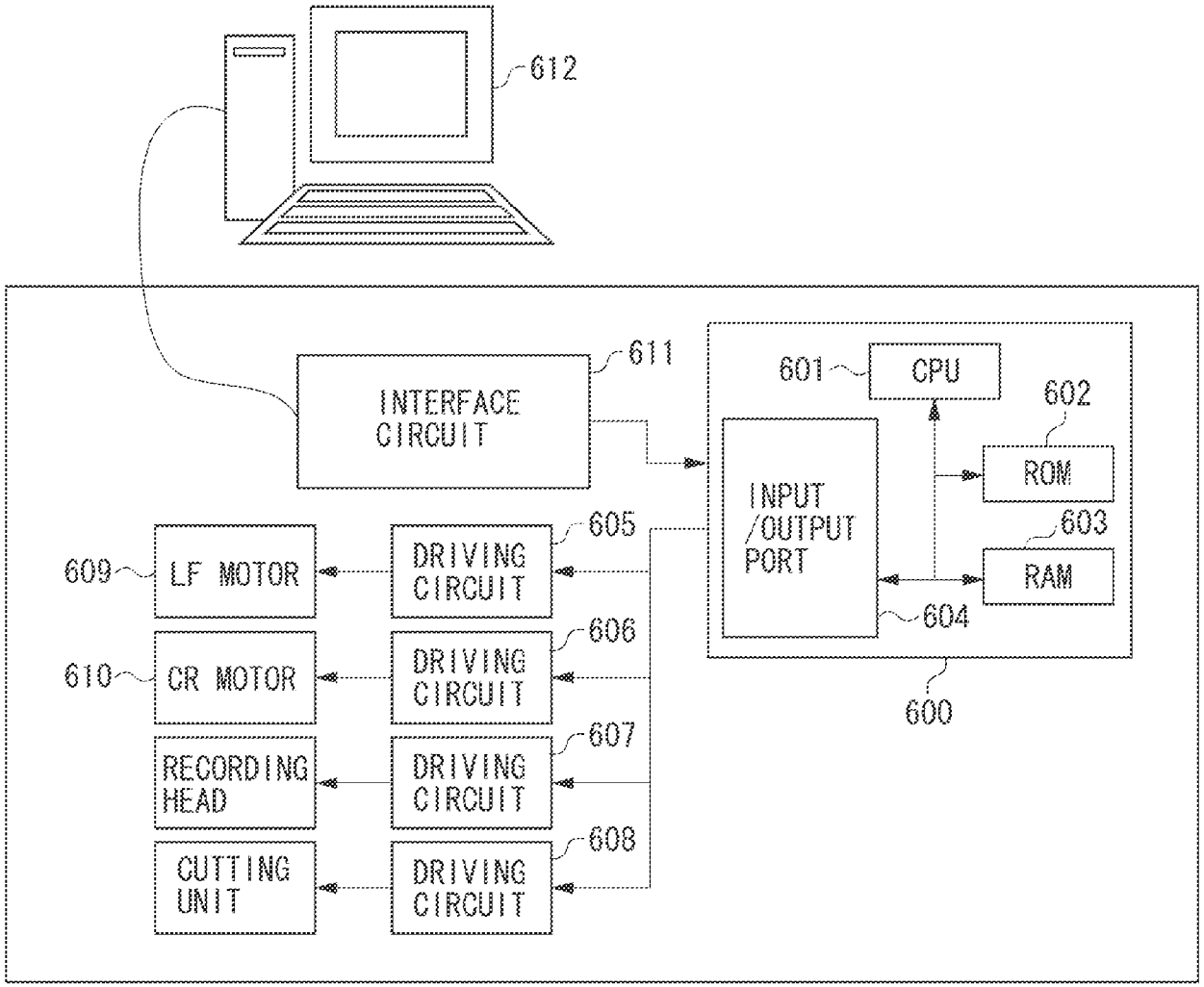
FIG. 5 is a block diagram schematically illustrating a configuration of a control system according to the exemplary embodiment of the present invention.

FIG. 5 is a block diagram schematically illustrating a configuration of a control system according to the present exemplary embodiment. A main control unit 600 includes a central processing unit (CPU) 601 configured to perform processing operations such as calculation, selection, determination, and control, a read only memory (ROM) 602 configured to store, for example, a control program to be executed by the CPU 601, a random access memory (RAM) 603 configured to be used as, for example, a buffer of recording data, an input/output port 604, and others. Then, respective driving circuits 605, 606, 607, and 608 as actuators for a conveyance motor (line feed (LF) motor) 609, a carriage motor (carriage return (CR) motor) 610, the discharge head 7, and a cutting unit are connected to the input/output port 604. Further, the main control unit 600 is connected to a host computer 612 via an interface circuit 611.

Figure 6:
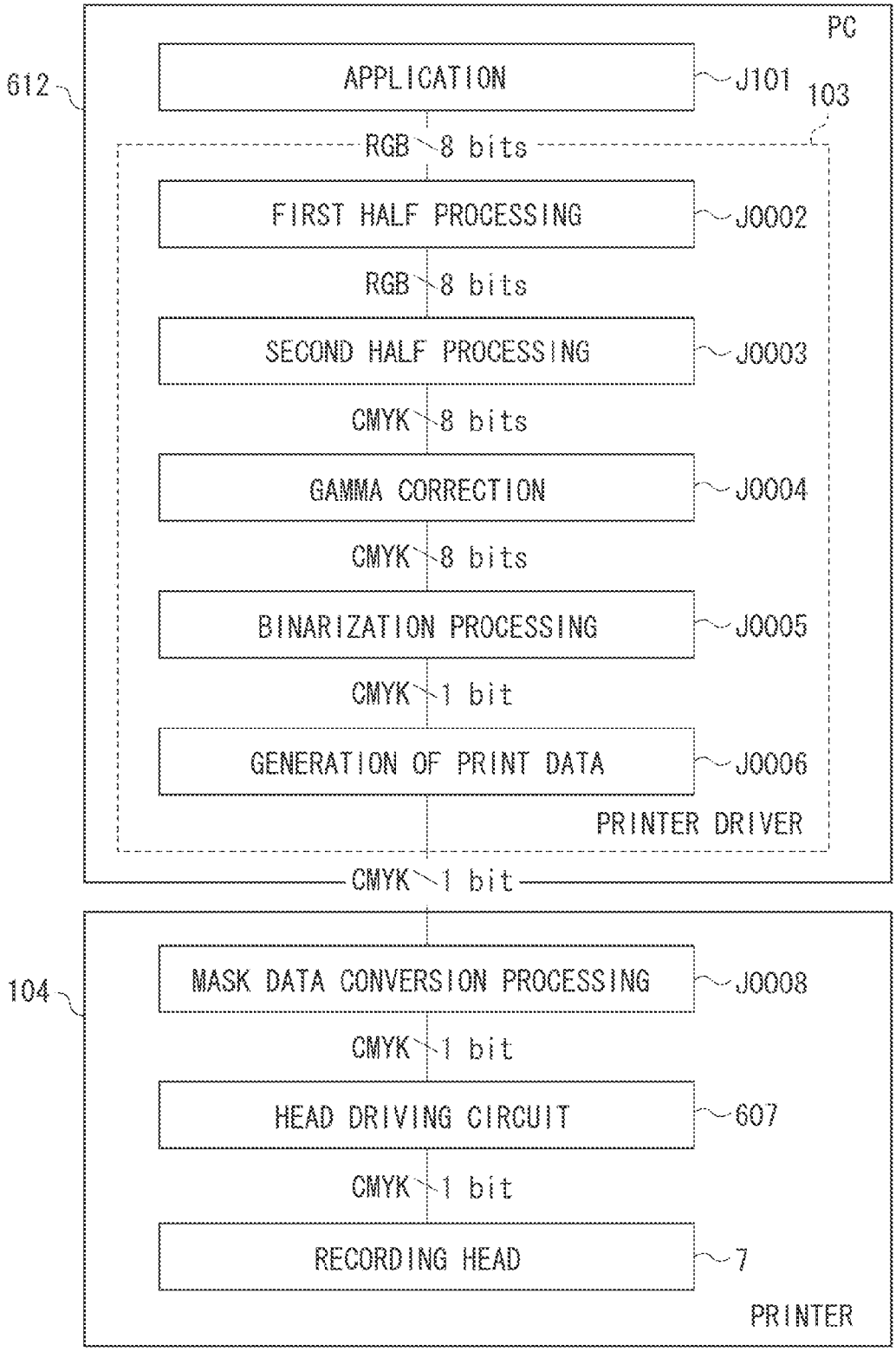
FIG. 6 is a block diagram illustrating a procedure for processing image data according to the exemplary embodiment of the present invention.

A recording operation performed by the thus-configured image recording apparatus will be described. FIG. 6 is a flowchart illustrating a procedure for processing image data. A user can generate data of an image to be recorded by a printer 104 via an application J101 of the host computer 612. At the time of recording, the image data generated by the application J101 is transmitted to a printer driver 103. The printer driver 103 performs each of first half processing J0002, second half processing J0003, a gamma correction J0004, binarization processing J0005, and generation of print data J0006 on the generated image data. In the first half processing J0002, the printer driver 103 performs color gamut conversion, i.e., converts a color gamut of a monitor of the host computer 612 into a color gamut of the printer 104. Specifically, the printer driver 103 converts image data R, G, and B in which R, G, and B are each expressed by 8 bits, into 8-bit data R, G, and B within the color gamut of the printer 104 by using a three-dimensional look-up table. In the second half processing J0003, the printer driver 103 separates colors for reproducing the converted gamut into a gamut of the inks. Specifically, the printer driver 103 determines 8-bit data C, M, Y, and K corresponding to a combination of inks that are used to reproduce the colors expressed by the 8-bit data R, G, and B within the color gamut of the printer 104, which is acquired by the first half processing J0002. In the gamma correction J0004, the printer driver 103 performs a gamma correction on each of the 8-bit data C, the 8-bit data M, the 8-bit data Y, and the 8-bit data K, which are acquired by the color separation. Specifically, the printer driver 103 converts each of the 8-bit data C, the 8-bit data M, the 8-bit data Y, and the 8-bit data K, which are acquired by the second half processing J0003, in such a manner that they are linearly associated with the graduation characteristic of the printer 104. In the binarization processing J0005, the printer driver 103 performs quantization processing, i.e., converts each of the 8-bit data C, the 8-bit data M, the 8-bit data Y, and the 8-bit data K, which are acquired by the gamma correction J0004, into 1-bit data C, M, Y, and K. This quantization unit can be realized by, for example, the density pattern method, the dither method, and the error diffusion method. In the print data generation processing J0006, the printer driver 103 generates 1-bit print data by adding, for example, print control data to image data containing the 1-bit data C, M, K, and Y acquired by the binarization processing J0005. The print control data includes, for example, recording medium information and recording quality information.

The thus-generated print data is supplied to the printer 104. In mask data conversion processing J0008, the printer 104 converts the print data into recording data that indicates whether a dot is formed, i.e., whether the ink is recorded from the discharge head 7, with use of the print data generated by the print data generation processing J0006 and data of a mask pattern, which will be described below. This mask pattern is constructed by arranging recording permitting pixels and recording non-permitting pixels according to a predetermined pattern. For the recording permitting pixels, the print data is converted into data that indicates permission of discharge of the ink. For the recording non-permitting pixels, the print data is converted into data that indicates nonpermission of discharge of the ink. The mask pattern used in the mask data conversion processing J0008 is stored in a predetermined memory of the printer 104 in advance. For example, the mask pattern can be stored in the above-described ROM 602, and the CPU 601 can convert the print data into the recording data using this mask pattern.

The recording data acquired by the mask data conversion processing J0008 is supplied to the head driving circuit 607 and the discharge head 7. The ink is discharged from the respective discharge ports arranged on the discharge head 7 onto the recording medium 3 based on this recording data.

The printer 104 performs a recording operation by controlling driving of, for example, each motor and the discharge head 7 via the input/output port 604 based on the discharge data generated by the above-described processing. The recording technique according to the present exemplary embodiment is realized by using the above-described method for generating recording data.

Hereinafter, the mask pattern according to the present exemplary embodiment will be described in detail.

Figure 8:
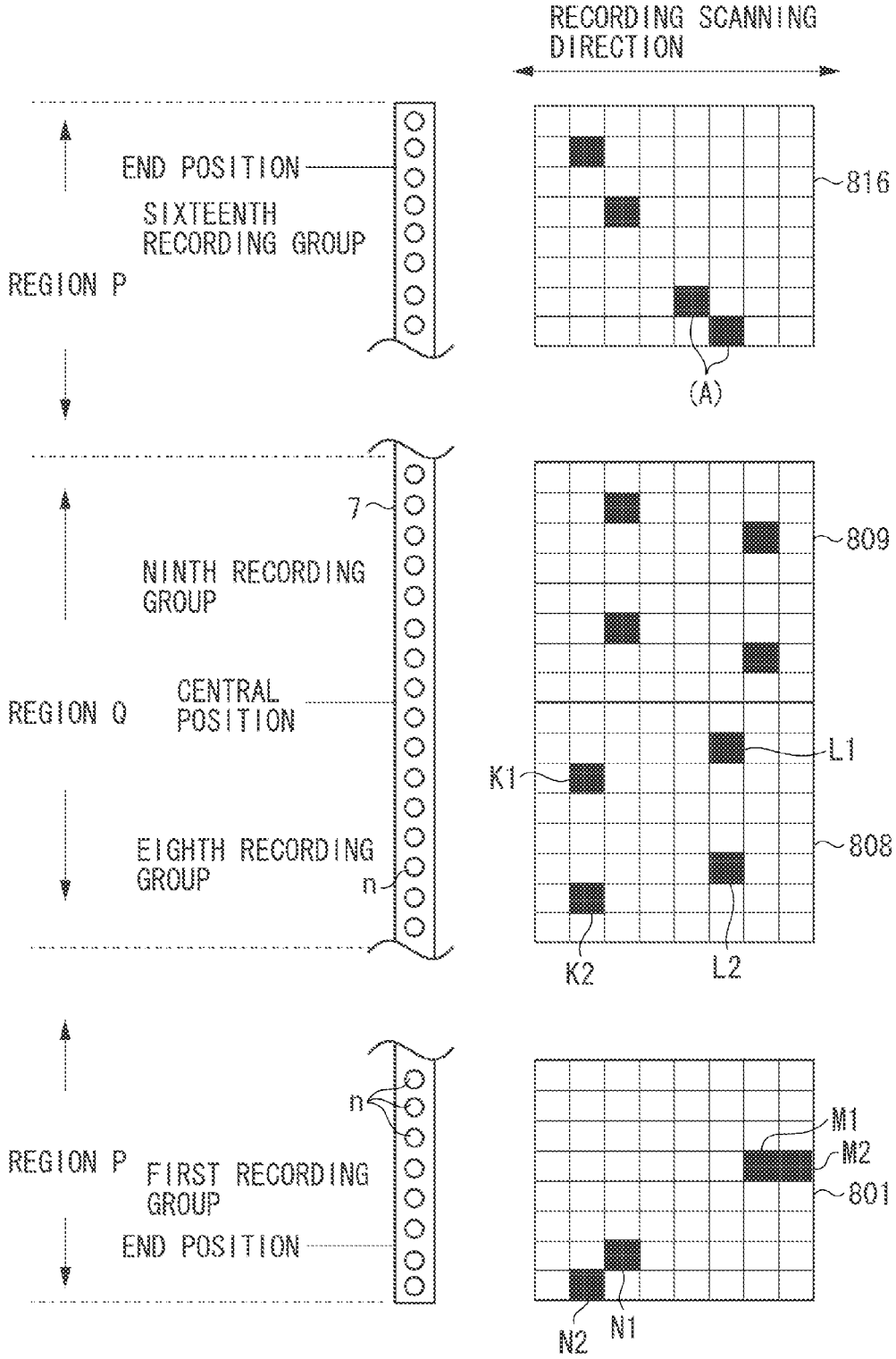
FIG. 8 illustrates a mask pattern according to a first exemplary embodiment of the present invention.

FIG. 8 illustrates an example of the mask pattern employed in the present exemplary embodiment.

First, a first exemplary embodiment will be described based on an example in which k is 128. 128 nozzles n formed at the discharge head 7 are divided into 16 nozzle groups from a first recording group to a sixteenth recording group, and different divided patterns (801 to 816) are employed for the respective recording groups. The mask pattern is a series of these divided patterns in a connected state. It is apparent that, at the stage of generation of this mask pattern, a mask pattern may be generated for a region corresponding to the entire nozzle groups, and a portion of the thus-acquired mask pattern corresponding to each divided pattern may be employed to each nozzle group. A conveyance amount in the sub-scanning direction after one recording operation in the recording scanning direction corresponds to the length of the nozzle array of the recording group.

The black cells in the mask pattern correspond to recording permitting pixels, and the white cells in the mask pattern correspond to recording non-permitting pixels. The recording permitting pixels are arranged in the respective recording groups in such a complementary relationship that all pixels are recorded by 16 times of recording scanning.

In the present exemplary embodiment, the recording permitting pixels are arranged in such a manner that the respective recording groups have a same number of recording permitting pixels. However, the present invention is not limited to this arrangement.

In the present exemplary embodiment, the first recording group to the seventh recording group, and the tenth recording group to the sixteenth recording group are located at end portions, and correspond to regions P where the temperature of the recording medium 3 is 50° C. or higher after, for example, 0.1 second has elapsed after the ink is recorded. On the other hand, the eighth recording group and the ninth recording group are located at a central portion relative to the first recording group to the seventh recording group and the tenth recording group to the sixteenth recording group, and correspond to a region Q where the temperature of the recording medium 3 is lower than 50° C. after, for example, 0.1 second has elapsed after the ink is recorded.

The present exemplary embodiment appropriately sets a divided pattern having a different distance between recording permitting pixels for each recording group. Next, a method for calculating a distance between recording permitting pixels will be described with reference to an example illustrated in FIG. 8.

The present exemplary embodiment calculates a distance between each of recording permitting pixels contained in a divided pattern constituted by 8 pixels×8 pixels, i.e., 64 pixels, and another recording permitting pixel located at a closest position thereto. Further, the present exemplary embodiment calculates the sum of the distances between the respective recording permitting pixels and the another recording permitting pixel, and divides the sum by the number of the recording permitting pixels to acquire the resultant value as the average of the distances between the recording permitting pixels in the divided pattern.

At this time, assuming that the distance between recording permitting pixels (the distance between pixel centers) is 1 in a case where the recording permitting pixels are adjacent to each other in the recording scanning direction or the sub-scanning direction, the present exemplary embodiment calculates a distance based on this assumption. If recording permitting pixels are obliquely separated, the distance between the recording permitting pixels is the square root of the sum of the squares of the respective distances therebetween in the recording scanning direction and the sub-scanning direction. For example, in a divided pattern 801 corresponding to the first recording group in the present exemplary embodiment, recording permitting pixels M1 and M2 are adjacent to each other in the recording scanning direction, whereby the distance between the recording permitting pixels M1 and M2 is 1. Further, recording permitting pixels N1 and N2 are separated from each other by 1 in the recording scanning direction and by 1 in the sub-scanning direction, whereby the distance between the recording permitting pixels N1 and N2 is $\sqrt{2}$, which is the square root of the sum of the squares of the respective distances. Further, the recording permitting pixels M1 and N1 are separated from each other by 4 in the recording scanning direction and by 3 in the sub-scanning direction, whereby the distance between the recording permitting pixels M1 and N1 is 5, which is the square root of the sum of the squares of the respective distances.

Further, the distance between each recording permitting pixel and another recording permitting pixel located at a closest position means the shortest distance between the recording permitting pixels, among the distances between the each recording permitting pixel and all of other recording permitting pixels. For example, in the divided pattern 801 corresponding to the first recording group in the present exemplary embodiment, the distances between the recording permitting pixel N1 and other recording permitting pixels, i.e., the recording permitting pixels N2, M1, and M2 are $\sqrt{2}$, 5, and $\sqrt{34}$, respectively, whereby the distance between the recording permitting pixel N1 and another recording permitting pixel located at a closest position thereto is $\sqrt{2}$, which is the distance to the recording permitting pixel N2.

According to this definition, the present exemplary embodiment calculates the distance between each of the recording permitting pixels N2, M1 and M2 and another recording permitting pixel located at a closest position thereto in a similar manner. The distances between the respective recording permitting pixels N2, M1 and M2 and another recording permitting pixel located at a closest position thereto are $\sqrt{2}$, 1, and 1.

Therefore, the sum of the distances between the respective recording permitting pixels N1, N2, M1, and M2 and another recording permitting pixel located at a closest position thereto is $2+2\sqrt{2}$, i.e., approximately 4.8. Accordingly, the average of the distances between the recording permitting pixels N1, N2, M1, and M2 in the divided pattern 801 corresponding to the first recording group is 1.2, which is a value calculated by dividing 4.8 by 4, i.e., the number of the recording permitting pixels N1, N2, M1, and M2.

Similarly, the present exemplary embodiment also calculates the average of the distances between recording permitting pixels in a divided pattern 808 corresponding to the eighth recording group. All of recording permitting pixels K1, K2, L1, and L2 have 4 as the distance to another recording permitting pixel located at a closest position thereto, whereby the present exemplary embodiment acquires 4 as the average of the distances between the recording permitting pixels K1, K2, L1, and L2 in the divided pattern 808 corresponding to the eighth recording group.

The present exemplary embodiment is being described herein, assuming that recording is completed by performing 16 times of recording scanning on a unit region. However, any appropriate number may be selected as the number of times of recording scanning according to, for example, properties of used ink and a used recording medium, and the present exemplary embodiment is not limited to the example employing 16 times of recording scanning.

As described above, approximately 1.21 is acquired as the average of the distances between the recording permitting pixels in the divided pattern 801 corresponding to the first recording group. In this manner, the positions of the recording permitting pixels are randomly set for the first recording group and the sixteenth recording group located at the end portions in the sub-scanning direction, whereby it is considered that ink droplets may be applied onto close positions during the same recording scanning. However, the temperature of the recording medium 3 is higher at the end portions than the temperature at the central portion, whereby the ink droplets can be quickly fixed, and beading is less likely to occur.

On the other hand, 3 is acquired as the average of the distances between the recording permitting pixels in the divided pattern 808 corresponding to the eighth recording group, and the positions of the recording permitting pixels are set in such a manner that this average becomes longer than the average of the distances between the recording permitting pixels in the divided pattern 801 corresponding to the first recording group. Therefore, it is possible to prevent occurrence of beading that otherwise may be caused in the region where the temperature is low on the surface of the recording medium 3 corresponding to the eighth recording group and the ninth recording group located at the central portion in the sub-scanning direction.

The present exemplary embodiment makes a comparison in terms of the average of the distances between a plurality of recording permitting pixels, among recording permitting pixels contained in the divided pattern constituted by 8 pixels×8 pixels, i.e., 64 pixels, between the central portion and the end portions. However, actually, if x pixels exist in the sub-scanning direction in a single divided pattern, the present exemplary embodiment calculates the average of the distances between recording permitting pixels from x pixels×x pixels, i.e., $x^2$ pixels.

Further, the present exemplary embodiment makes a comparison in terms of the average of the distances between recording permitting pixels. However, the shortest distances between recording permitting pixels in the respective divided patterns are also in a similar magnitude relationship to the above-described averages of the distances between recording permitting pixels. In the first recording group, the shortest distance between recording permitting pixels is 1, which is the distance between the recording permitting pixel M1 and the recording permitting pixel M2. In the eighth recording group, the shortest distance between recording permitting pixels is 4, which is the distance between the recording permitting pixel K1 and the recording permitting pixel K2.

In this manner, at the central portion in the sub-scanning direction, where the temperature is low after the ink is applied, even if it takes a long time to increase the viscosity so that the ink spreads on the recording medium 3 to some degree, the ink is applied to such positions that ink droplets cannot contact each other during the same recording scanning, whereby it is possible to prevent occurrence of beading. On the other hand, the recording permitting pixels are located adjacent to each other at the end portions in the sub-scanning direction, where the temperature is high after the ink is applied. However, at these portions, moisture in the ink can be smoothly evaporated by the heat, and the recording material can be quickly fixed. Therefore, beading is less likely to occur due to contact between ink droplets, having little influence on the image quality of a recorded image.

It should be noted that the recording permitting pixels can be separated by 60 μm or longer as the distance between recording permitting pixels, by which it becomes possible to prohibit ink droplets from contacting each other while permitting them to spread on the recording medium 3. The present exemplary embodiment is being described based on an example that having resolution of 1200 dpi in both the recording scanning direction and the sub-scanning direction, and the distance 60 μm corresponds to approximately 3 pixels in the resolution of 1200 dpi. However, the degree of wetting and spreading of the ink on the recording medium 3 varies depending on various factors such as flowability of the ink, permeability of the recording medium 3, and the degree of heating. Therefore, this distance between recording permitting pixels should be appropriately set according to the properties of the ink, the recording medium 3, the heating device, and the like, and the present exemplary embodiment is not limited to the configuration in which the recording permitting pixels are separated by 3 pixels or more.

Further, in the above description, the present exemplary embodiment has been described based on an example in which k is 128, and an image is completed on the unit region by 16 times of recording scanning. However, the number of discharge ports n and the number of times of recording scanning can be arbitrarily determined.

Figure 9:
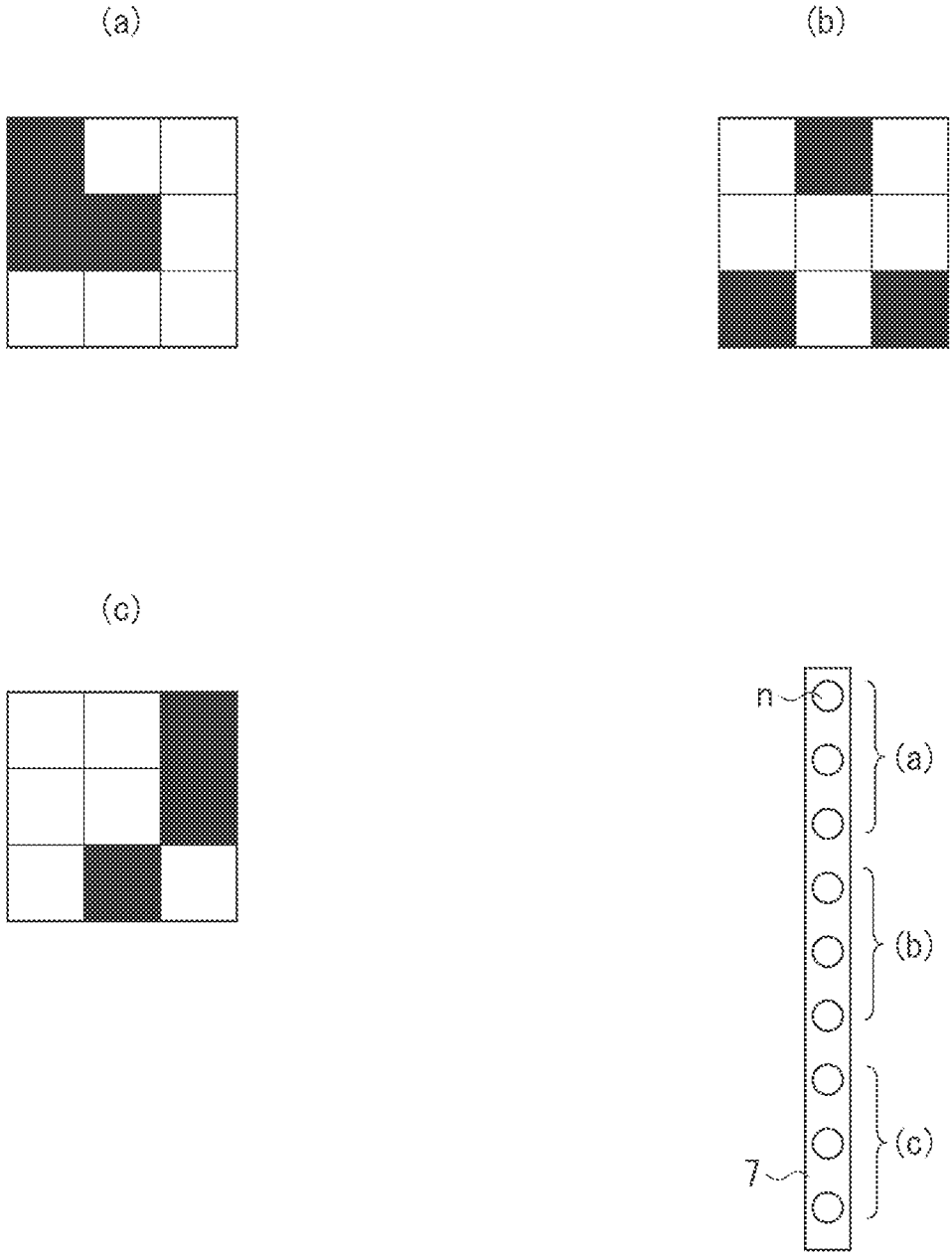
FIG. 9 illustrates an example of a mask pattern employable in the first exemplary embodiment of the present invention.

FIG. 9 illustrates an example in which k is 9, and an image is completed on a unit region by 3 times of recording scanning. Patterns illustrated in parts (a), (b), and (c) in FIG. 9 correspond to first, second, and third recording scanning, respectively. The recording medium 3 is conveyed by a distance corresponding to 3 nozzles between recording scanning operations. Therefore, parts (a), (b), and (c) correspond to first to third nozzles n at the upper end portion of the discharge head 7, fourth to sixth nozzles n at the central portion of the discharge head 7, and seventh to ninth nozzles n at the lower end portion of the discharge head 7, respectively. If the averages of the distances between recording permitting pixels corresponding to the respective recording scanning operations are calculated according to the above-described calculation method, they are calculated as 1, 2.1, and 1.1 for the respective divided patterns corresponding to the first, second, and third recording scanning. In this manner, the average of the distances between recording permitting pixels is longer in the divided pattern corresponding to the second recording scanning corresponding to the central portion in the sub-scanning direction, than the averages of the distances between recording permitting pixels in the divided patterns corresponding to the first and third recording scanning corresponding to the end portions in the sub-scanning direction.

Figure 10:
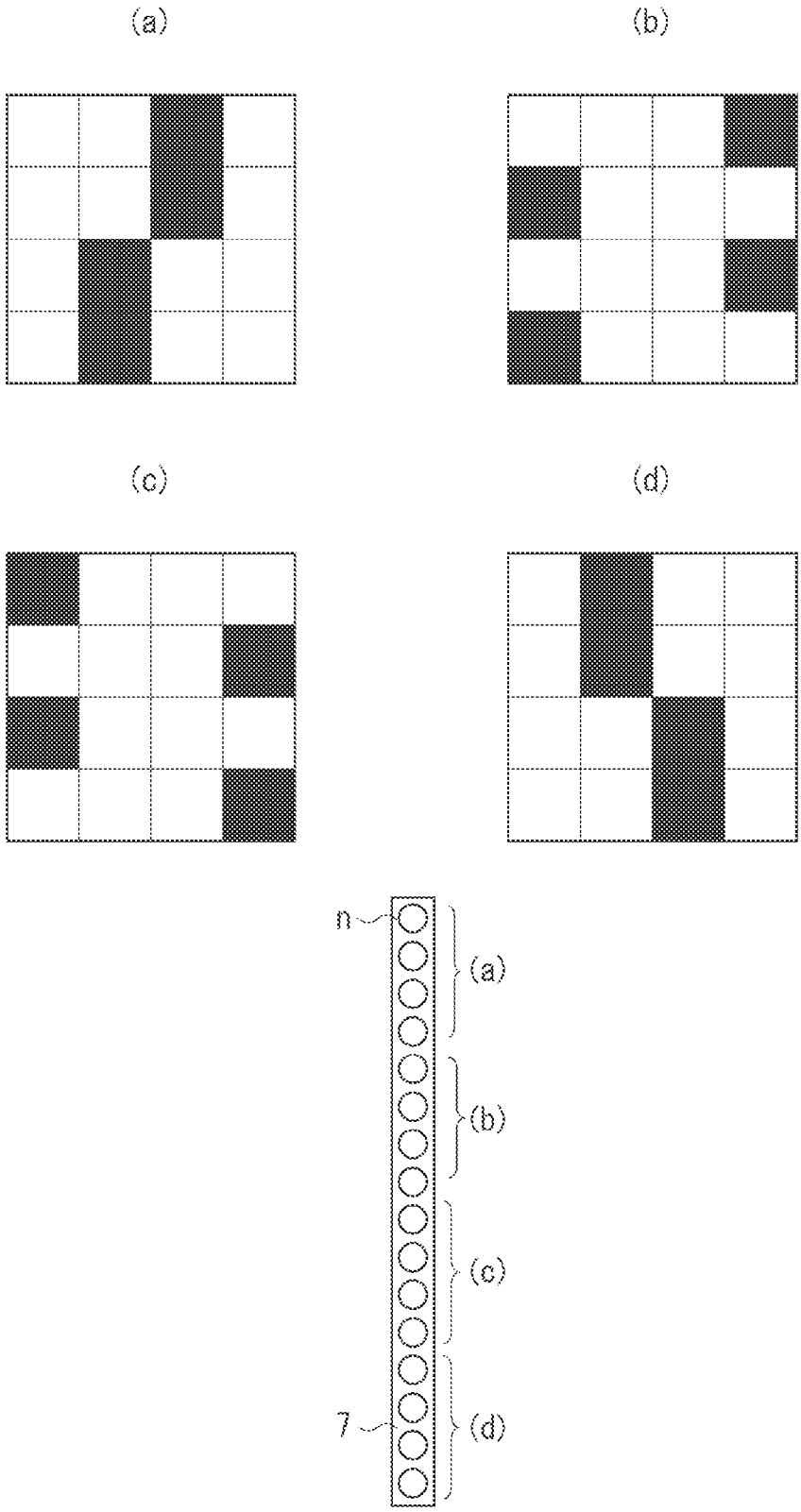
FIG. 10 illustrates an example of a mask pattern employable in the first exemplary embodiment of the present invention.

Further, FIG. 10 illustrates an example in which k is 16, and an image is completed on a unit region by 4 times of recording scanning. Parts (a), (b), (c), and (d) in FIG. 10 correspond to first, second, third, and fourth recording scanning, respectively. The recording medium 3 is conveyed by a distance corresponding to 4 nozzles between recording scanning operations. Therefore, parts (a), (b), (c), and (d) correspond to first to fourth nozzles n at the upper end portion of the discharge head 7, fifth to eighth nozzles n, ninth to twelfth nozzles n, and thirteenth to sixteenth nozzles n, respectively. Even in this example, 1, 2, 2, and 1 are respectively acquired as the averages of the distances between recording permitting pixels in divided patterns respectively corresponding to the first, second, third, and fourth recording scanning. In this manner, the averages of the distances between recording permitting pixels are longer in the divided patterns corresponding to the second and third recording scanning corresponding to the central portion in the sub-scanning direction, than the averages of the distances between recording permitting pixels in the divided patterns corresponding to the first and fourth recording scanning corresponding to the end portions in the sub-scanning direction.

Figure 7:
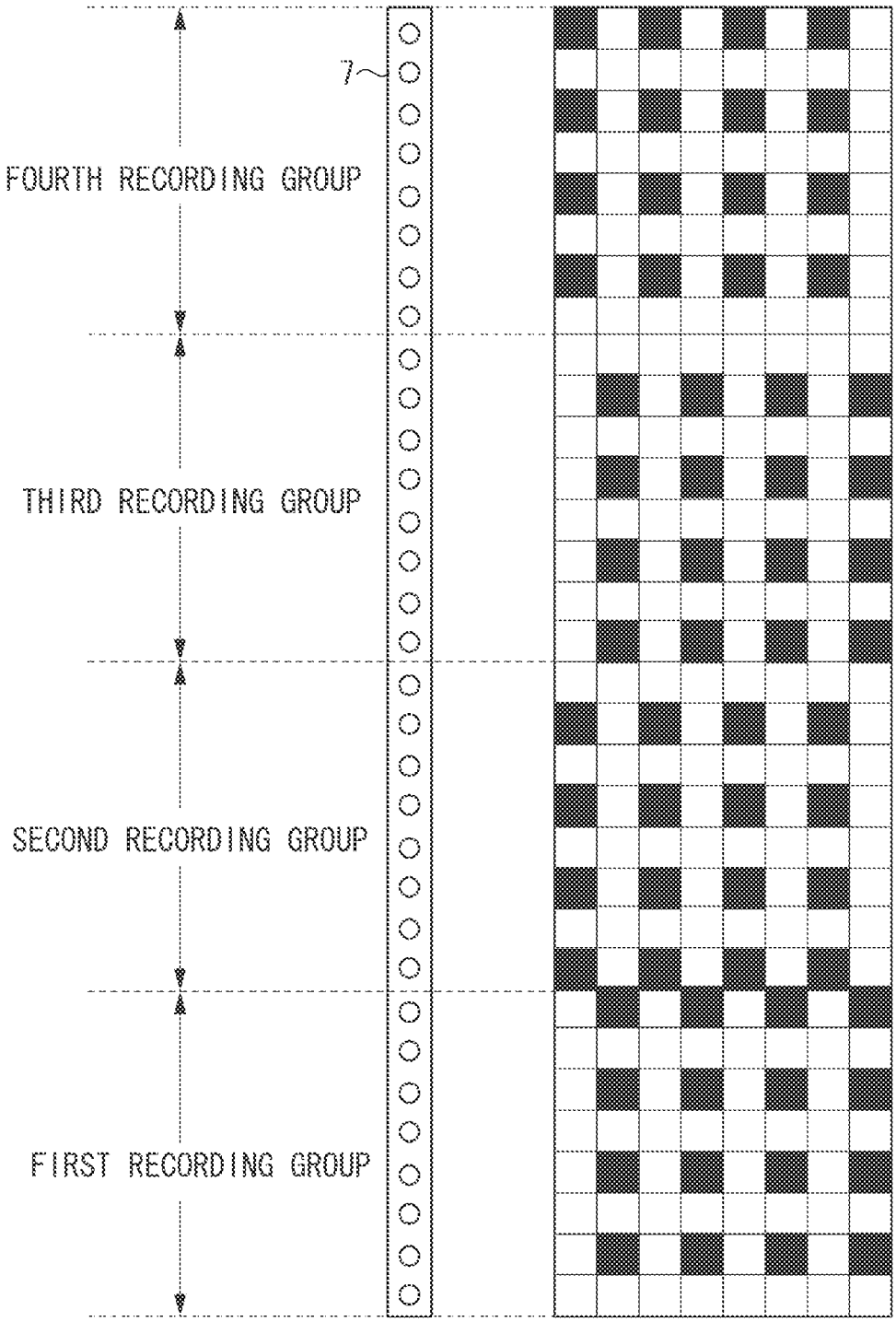
FIG. 7 is a schematic view illustrating a commonly-used multipass recording method discussed in Japanese Patent Application Laid-Open No. 2006-44258.

A mask pattern illustrated in FIG. 7 will be described as a comparative example of the present exemplary embodiment.

According to the mask pattern of this comparative example, recording scanning is performed on a unit region four times. Therefore, the distance between pixels is evenly set to 2 in all of divided patterns corresponding to a first recording group to a fourth recording group. Accordingly, the average of the distances between recording permitting pixels is 2 in each divided pattern. If the ink is discharged onto a recording medium by a recording apparatus equipped with the above-described heating device, the temperature is relatively low in a region on the recording medium corresponding to the second and third recording groups located at the central portion of the discharge port array, compared to regions on the recording medium corresponding to the first and fourth recording groups located at the end portions of the discharge port array. As described above, beading is more highly likely to occur at a low-temperature portion on the recording medium than a high-temperature portion. Therefore, according to this comparative example, beading more highly likely occurs on the region on the recording medium corresponding to the second and third recording groups, compared to the example in which the averages of the distances between recording permitting pixels are longer in the second and third recording groups than the averages of the distances between recording permitting pixels in the first and fourth recording groups.

Hereinafter, a mask pattern according to a second exemplary embodiment of the present invention will be described in detail.

Figure 11:
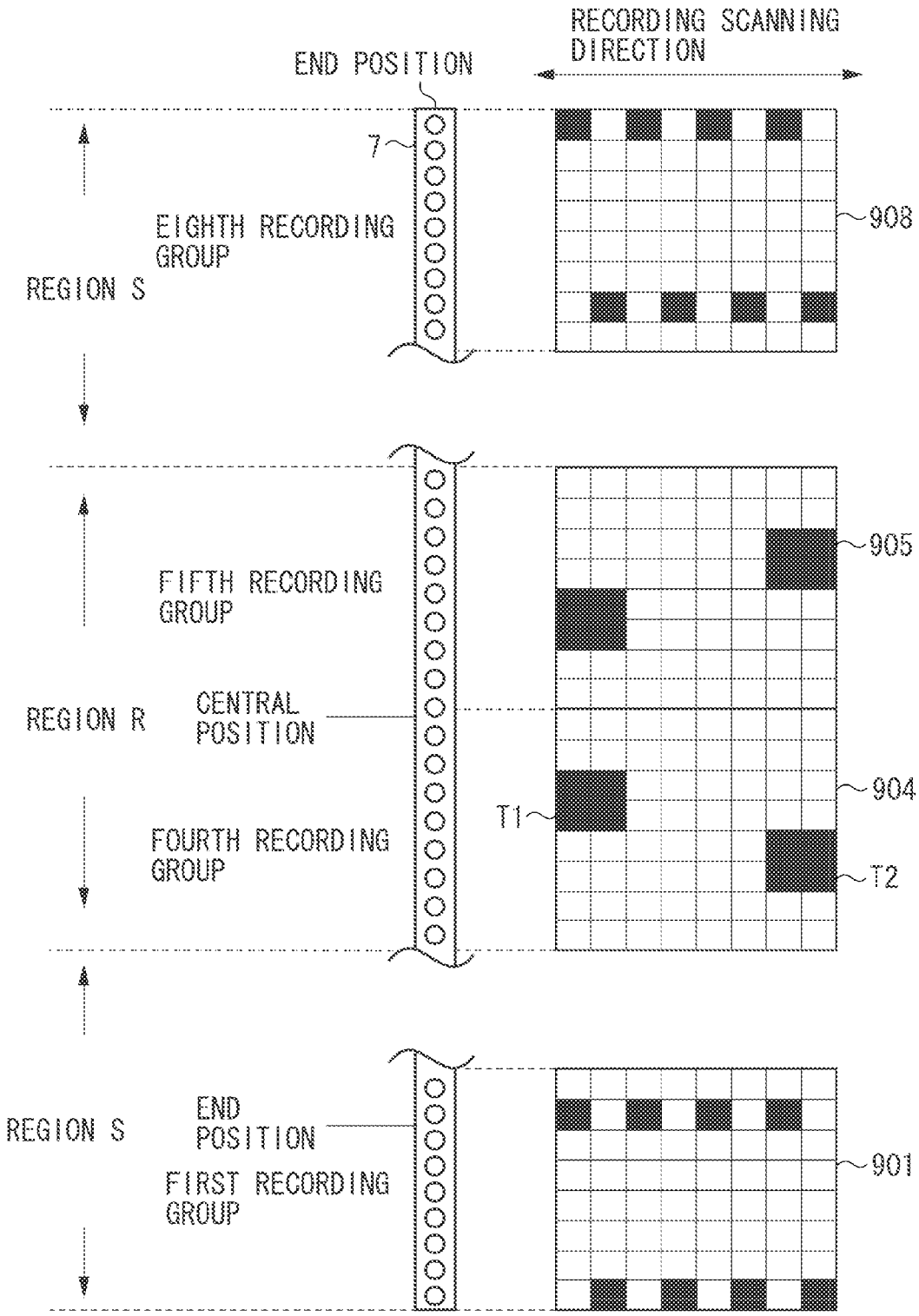
FIG. 11 illustrates a mask pattern according to a second exemplary embodiment of the present invention.

FIG. 11 illustrates an example of the mask pattern employed in the second exemplary embodiment.

The present exemplary embodiment will be described based on an example in which k is 64. 64 nozzles are divided into 8 nozzle groups, namely, a first recording group to an eighth recording group. Different divided patterns (901 to 908) are employed for the respective recording groups. The recording permitting pixels are arranged in the respective divided patterns 901 to 908 in such a complementary relationship that all pixels are recorded by 8 times of recording scanning, and the positions of the recording permitting pixels are set in such a manner that an image is completed on a unit region by 8 times of recording scanning.

In the present exemplary embodiment, the first to third recording groups and the sixth to eighth recording groups are located at the end portions, and correspond to regions S where the temperature of the recording medium 3 is 50° C. or higher. On the other hand, the fourth and fifth recording groups are located at the central portion relative to the other recording groups, and correspond to a region R where the temperature of the recording medium 3 is lower than 50° C.

The present exemplary embodiment appropriately sets, for each recording group, a divided pattern that has different values as the average of the numbers of recording permitting pixels within recording permitting pixel set units, and the average of the distances between the recording permitting pixel set units. The recording permitting pixel set unit is either a recording permitting pixel group constituted by a series of the above-described plurality of recording permitting pixels located adjacent to each other, or a recording permitting pixel with no other recording permitting pixel adjacent thereto.

Figure 12:
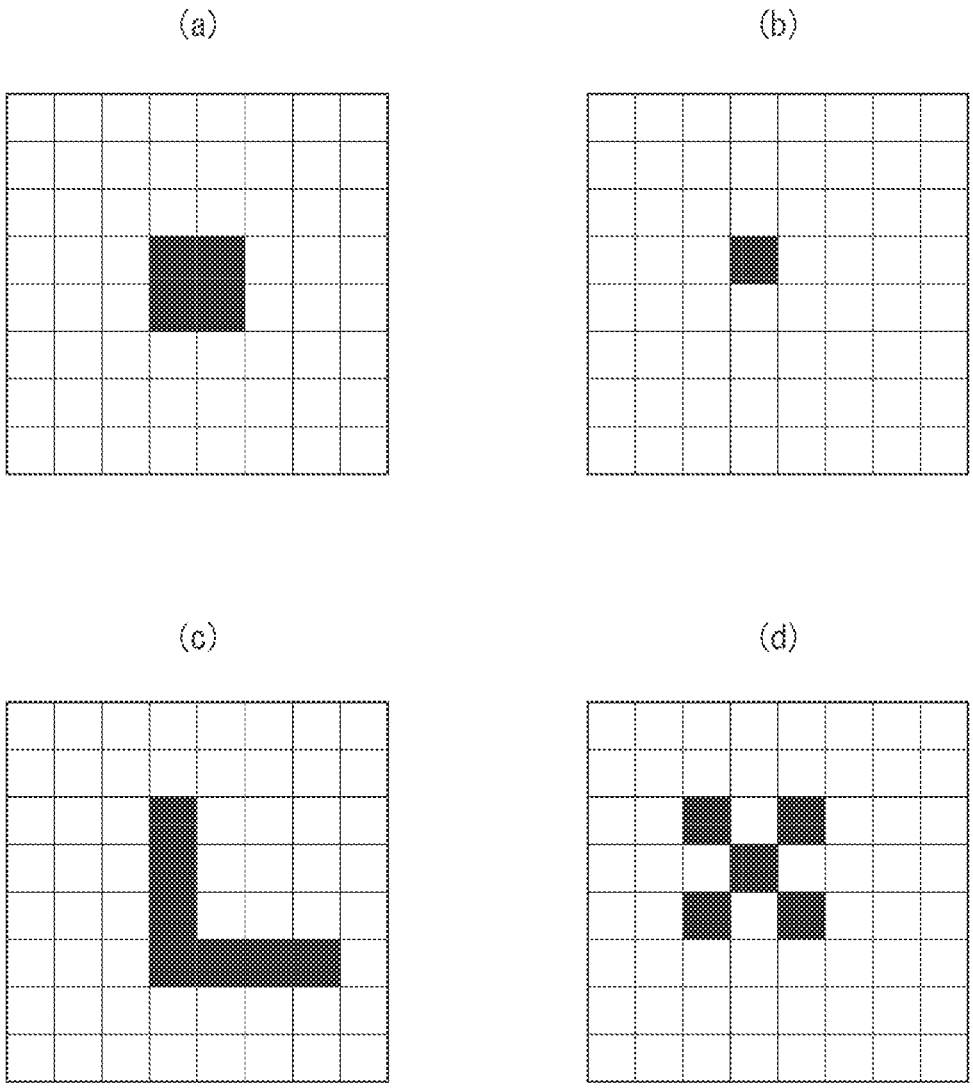
FIG. 12 illustrates recording permitting pixel set units according to the second exemplary embodiment of the present invention.

FIG. 12 is a diagram for facilitating better understanding about the definition of the recording permitting pixel group, and the average of the numbers of recording permitting pixels in recording permitting pixel groups according to the present exemplary embodiment.

As described above, the recording permitting pixel group is constituted by a plurality of recording permitting pixels located at positions adjacent to each other. For example, part (a) in FIG. 12 illustrates a square-shaped recording permitting pixel group constituted by 2 pixels×2 pixels, i.e., 4 pixels. In this case, the number of recording permitting pixels in the recording permitting pixel group is 4.

Further, in the present exemplary embodiment, even a recording permitting pixel without any recording permitting pixel adjacent thereto is also referred to as a recording permitting pixel set unit. Part (b) in FIG. 12 illustrates a recording permitting pixel with no recording permitting pixel adjacent thereto. In this case, the number of recording permitting pixels in the recording permitting pixel set unit is 1.

Further, even a plurality of recording permitting pixels adjacent to each other disproportionately in a predetermined direction is a recording permitting pixel group according to the present exemplary embodiment, and the recording permitting pixel group according to the present exemplary embodiment is not limited to an isotropic shape as illustrated in part (a) in FIG. 12. Part (c) in FIG. 12 illustrates an L-shaped recording permitting pixel group adjacent to each other disproportionately in a predetermined direction. In this case, the number of recording permitting pixels in the recording permitting pixel group is 7.

Further, adjacent recording permitting pixels according to the present exemplary embodiment include not only recording permitting pixels adjacent to each other in the recording scanning direction and the sub-scanning direction but also recording permitting pixels adjacent to each other in an oblique direction. In other words, a single recording permitting pixel may have total eight recording permitting pixels positioned adjacent thereto, i.e., two recording permitting pixels in the recording scanning direction, two recording permitting pixels in the sub-scanning direction, and four recording permitting pixels in oblique directions. Part (d) in FIG. 12 illustrates recording permitting pixels adjacent to each other in oblique directions. In this case, the number of recording permitting pixels in the recording permitting pixel group is 5.

The present exemplary embodiment calculates the average of the numbers of recording permitting pixels in recording permitting pixel set units, and the distance between the recording permitting pixel set units according to a method that will be described now with reference to the example illustrated in FIG. 11.

The present exemplary embodiment calculates the number of recording permitting pixel set units included in a divided pattern constituted by 8 pixels×8 pixels, i.e., 64 pixels, and calculates the number of recording permitting pixels within each recording permitting pixel set unit. Further, the present exemplary embodiment calculates the sum of the numbers of the recording permitting pixels within the respective recording permitting pixel set units, and divides the sum by the number of the recording permitting pixel set units to acquire the resultant value as the average of the numbers of the recording permitting pixels within the recording permitting pixel set units in the divided pattern.

For example, in a divided pattern 904 corresponding to the fourth recording group in the present exemplary embodiment, recording permitting pixel set units T1 and T2 are constituted by four recording permitting pixels adjacent to each other, respectively. Therefore, the average of the numbers of the recording permitting pixels within the recording permitting pixel set units in the divided pattern 904 is 4, which is a value acquired by dividing 8 as the sum of the numbers of the recording permitting pixels within the respective recording permitting pixel set units T1 and T2 by 2 as the number of the recording permitting pixel set units T1 and T2.

On the other hand, there is no recording permitting pixel adjacent to each other in a divided pattern 901 corresponding to the first recording group. If stated in another way according to the above-described definition, there are eight recording permitting pixel set units in total, in each of which the number of recording permitting pixels in the recording permitting pixel set unit is 1. Therefore, the average of the numbers of the recording permitting pixel within the recording permitting pixel set units in the divided pattern 901 is 1, which is a value acquired by dividing 8 as the sum of the numbers of the recording permitting pixel within the respective recording permitting pixel set units by 8 as the number of the recording permitting pixel set units.

Figure 13:
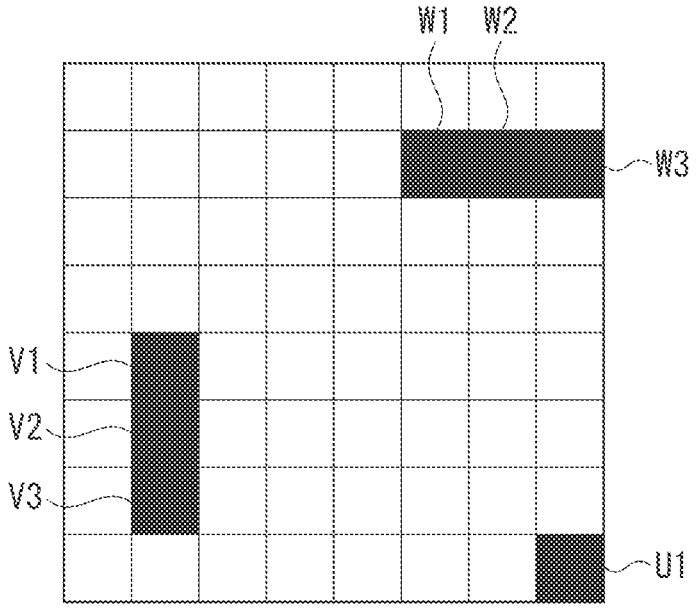
FIG. 13 is a diagram for facilitating better understanding about a distance between the recording permitting pixel set units according to the second exemplary embodiment of the present invention.
Figure 14:
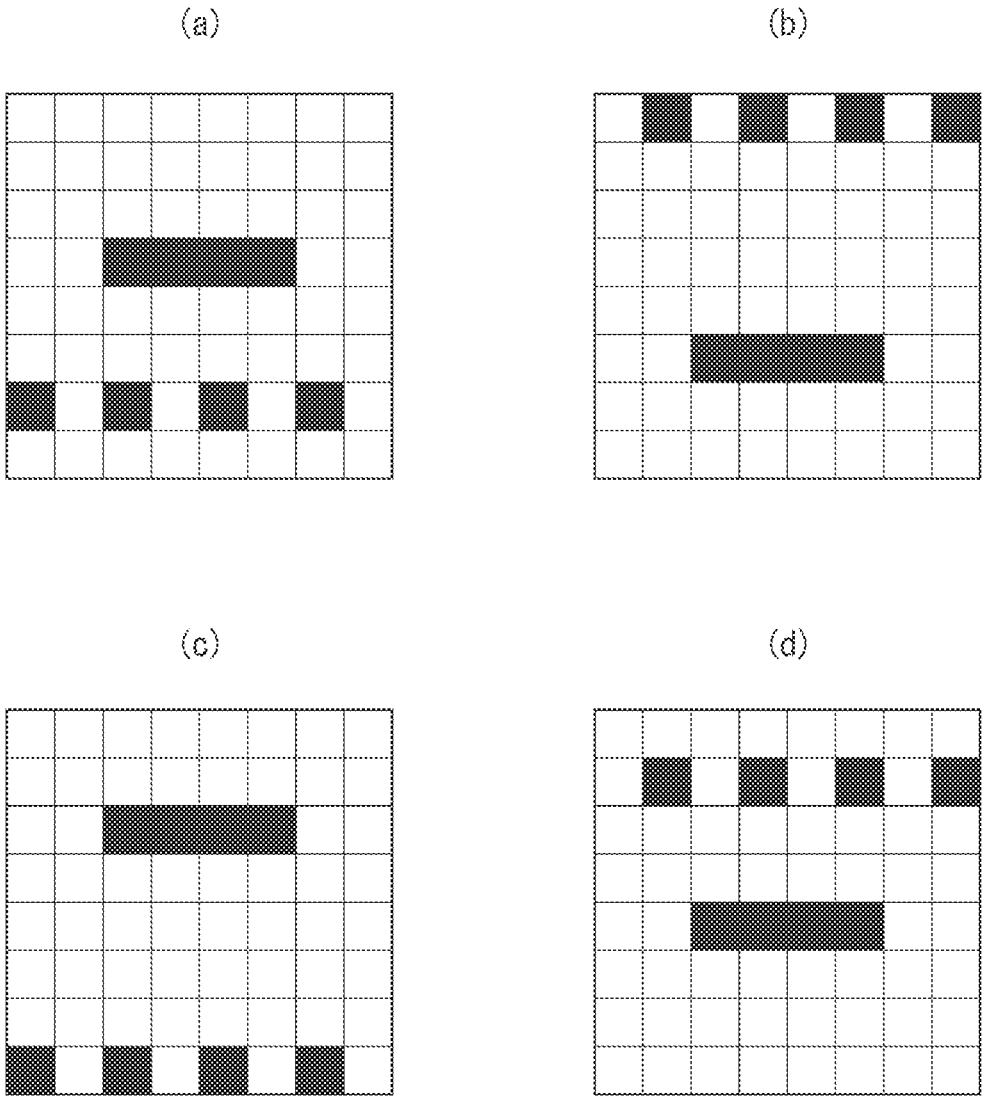
FIG. 14 illustrates an example of a mask pattern employable in the second exemplary embodiment of the present invention.

FIG. 13 is a diagram for facilitating better understanding about the average of the distances between recording permitting pixel set units according to the present exemplary embodiment.

Three recording permitting pixel set units are arranged in a divided pattern illustrated in FIG. 13. More specifically, this divided pattern includes a recording permitting pixel set unit constituted by a single recording permitting pixel U1, a recording permitting pixel set unit constituted by three recording permitting pixels V1, V2, and V3, and a recording permitting pixel set unit constituted by three recording permitting pixels W1, W2, and W3.

Then, the present exemplary embodiment calculates the distance between each of the recording permitting pixels within each of the recording permitting pixel set units included in the divided pattern constituted by 8 pixels×8 pixels, i.e., 64 pixels, and another recording permitting pixel located at a closest position thereto. The present exemplary embodiment sets the shortest distance between recording permitting pixels among distances between the respective recording permitting pixels in a target recording permitting pixel set unit and another recording permitting pixel located at a closest position thereto, as the distance between this recording permitting pixel set unit and another recording permitting pixel located at a closest position thereto. Further, the present exemplary embodiment calculates the sum of the distances between the respective recording permitting pixel set units and another recording permitting pixel located at a closest position thereto, and divides this sum by the number of the recording permitting pixel set units to acquire the resultant value as the average of the distances between the recording permitting pixels within the recording permitting pixel set units in the divided pattern.

The present exemplary embodiment calculates the average of the distances between recording permitting pixels in recording permitting pixel set units in a divided pattern according to a method that will be specifically described now with reference to FIG. 13.

First, the present exemplary embodiment calculates the distance between the recording permitting pixel set unit constituted by the three recording permitting pixels V1, V2, and V3, and another recording permitting pixel located at a closest position thereto, in the divided pattern illustrated in FIG. 13. More specifically, the present exemplary embodiment calculates the distances between the recording permitting pixel V1 among the three recording permitting pixels V1, V2, and V3, and other recording permitting pixels U1, W1, W2, and W3. At this time, the present exemplary embodiment calculates the distance between recording permitting pixels in a similar manner to the first exemplary embodiment. Therefore, the present exemplary embodiment calculates the square root of the sum of the squares of the distances between recording permitting pixels in the respective recording scanning direction and sub-scanning direction, as the distance between the recording permitting pixels. Therefore, $\sqrt{45}$, 5, $\sqrt{34}$, and $\sqrt{45}$ are acquired as the distances between the recording permitting pixel V1, and the recording permitting pixels U1, W1, W2, and W3, respectively. The present exemplary embodiment calculates the distances between the recording permitting pixel V2, and the recording permitting pixels U1, W1, W2, and W3 in the other recording permitting pixel set units in a similar manner, and acquires $\sqrt{40}$, $\sqrt{32}$, $\sqrt{41}$, and $\sqrt{52}$ as these distances, respectively. Further, the present exemplary embodiment calculates the distances between the recording permitting pixel V3, and the recording permitting pixels U1, W1, W2, and W3 in the other recording permitting pixel set units in a similar manner, and acquires $\sqrt{37}$, $\sqrt{41}$, $\sqrt{50}$, and $\sqrt{61}$ as these distances, respectively. Therefore, the distance between the recording permitting pixel set unit constituted by the recording permitting pixels V1, V2, and V3, and another recording permitting pixel located at a closest position thereto is calculated as 5, which is the distance between the recording permitting pixels V1 and W1 and the shortest distance among the above-described distances.

Similarly, the present exemplary embodiment calculates the distance between each of the recording permitting pixel set unit constituted by the three recording permitting pixels W1, W2, and W3, and the recording permitting pixel set unit constituted by the single recording permitting pixel U1, and another recording permitting pixel located at a closest position thereto. The present exemplary embodiment calculates the distance between the recording permitting pixel set unit constituted by the three recording permitting pixels W1, W2, and W3, and another recording permitting pixel located at a closest position thereto, and acquires 5, which is the distance between the recording permitting pixels W1 and V1. On the other hand, the present exemplary embodiment calculates the distance between the recording permitting pixel set unit constituted by the single recording permitting pixel U1, and another recording permitting pixel located at a closest position thereto, and acquires 6, which is the distance between the recording permitting pixels U1 and W3.

Therefore, 5, 5, and 6 are acquired as the distances between the respective recording permitting pixel set units and another recording permitting pixel located at a closest position thereto in the divided pattern illustrated in FIG. 13, respectively, and the sum of them is calculated as 16. The average of the distances between the recording permitting pixels in the recording permitting pixel set units according to the present exemplary embodiment is approximately 5.3, which is a value acquired by dividing 16 as the sum by 3 as the number of the recording permitting pixel set units.

According to the above-described definition, the present exemplary embodiment calculates the averages of the distances between recording permitting pixel set units in the divided patterns 904 and 901 in the present exemplary embodiment illustrated in FIG. 11. The average of the distances between the recording permitting pixel set units is $\sqrt{26}$ in the divided pattern 904, and the average of the distances between the recording permitting pixel set units is 2 in the divided pattern 901, which is a smaller value than the average $\sqrt{26}$ of the distances between the recording permitting pixel set units in the divided pattern 904.

As described above, in the present exemplary embodiment, the averages of the numbers of the recording permitting pixels in the recording permitting pixel set units in the divided patterns 904 and 905 corresponding to the region R (the nozzle central portion in the present example), which is the low-temperature portion, are larger than the averages of the numbers of the recording permitting pixels in the recording permitting pixel set units in the divided patterns 901 and 908 corresponding to the regions S (the nozzle end portions in the present example), which are the high-temperature portions.

Further, the averages of the distances between the recording permitting pixel set units in the divided patterns 904 and 905 are longer than the averages of the distances between the recording permitting pixel set units in the divided patterns 901 and 908. The distance between the recording permitting pixel set units in the divided patterns 904 and 905 is set to 60 μm at least in a similar manner to the first exemplary embodiment.

A plurality of ink droplets discharged from recording nozzles corresponding to a recording permitting pixel set unit during the same scanning may be combined by contacting one another on the recording medium 3, thereby forming a single large dot.

Recording a plurality of recording permitting pixels with the pixels combined to one another can increase the distance between recording permitting pixel set units, compared to dispersively printing the recording permitting pixels. Therefore, even through a large dot is formed on the recording medium 3, large dots can be located at positions separated away from each other, whereby beading can be prevented from occurring between the large dots.

However, on a region where the temperature does not lower so much on the recording medium so that the viscosity of the ink increases before beading occurs, like the region corresponding to the end portion, applying ink droplets dispersively like the conventional technique can provide a fine image with less granularity.

Therefore, according to the present exemplary embodiment, the recording permitting pixels are dispersively arranged so as to apply respective ink droplets at separated positions as far away as possible, like the conventional technique, at the end portions in the sub-scanning direction, where the temperature does not lower so much on the recording medium 3.

On the other hand, at the central portion in the sub-scanning direction, which is the low-temperature portion, a grainy effect due to formation of large dots involves a smaller number of dots compared to a large number of dots being connected due to formation of dots at positions close to one another, thereby less affecting the entire image. Therefore, a plurality of recording permitting pixels are arranged so as to gather together at the central portion in the sub-scanning direction.

Employment of the mask pattern described in the description of the present exemplary embodiment can prevent occurrence of density unevenness due to the temperature of the recording medium 3 while avoiding a reduction in an ink amount (a recording duty) discharged during one scanning operation.

The present exemplary embodiment has been described based on the mask pattern corresponding to the example in which the number of times of recording scanning is 8. However, the present exemplary embodiment is not limited to this number of times of recording scanning.

FIG. 11 illustrates the divided patterns corresponding to the first, fourth, fifth, and eighth recording groups. FIG. 12 illustrates examples of divided patterns corresponding to the other recording groups, i.e., the second, third, sixth, and seventh recording groups. The average of the numbers of recording permitting pixels within recording permitting pixel set units, and the average of the distances between the recording permitting pixel set units in the divided patterns corresponding to the second and seventh recording groups are calculated according to the above-described calculation method, as a result of which, 1.6 and 2.2 are acquired as these averages, respectively. Similarly, the average of the numbers of recording permitting pixels within recording permitting pixel set units in the divided patterns corresponding to the third and sixth recording groups is calculated as 1.6, and the average of the distances between the recording permitting pixel set units is calculated as 2.6. In this manner, the average of the numbers of the recording permitting pixels within the recording permitting pixel set units, and the average of the distances between the recording permitting pixel set units in each divided pattern are respectively values between the average 1 of the numbers of the recording permitting pixels within the set units and the average 2 of the distances between the set units in the divided patterns corresponding to the first and eighth recording groups, and the average 4 of the numbers of the recording permitting pixels within the set units and the average $\sqrt{26}$ of the distances between the set units in the divided patterns corresponding to the fourth and fifth recording groups. In the present exemplary embodiment, the recording permitting pixels in the divided patterns corresponding to the respective recording groups can be arranged at positions exclusive relative to one another, and a complementary relationship can be established among the recording permitting pixels in all of the groups, in a similar manner to the divided patterns corresponding to the respective recording groups illustrated in FIGS. 10 and 12.

Further, in the mask pattern according to the present exemplary embodiment, each recording permitting pixel set unit is constituted by adjacent four recording permitting pixels, but the present invention is not limited to this example.

An important characteristic feature of the present exemplary embodiment lies in separating recording permitting pixel set units from each other by a distance long enough to prevent beading from occurring between the recording permitting pixel set units, and does not involve the size of a recording permitting pixel set unit.

Therefore, the number of recording permitting pixels constituting a recording permitting pixel set unit can be arbitrarily set according to, for example, the number of times of recording scanning and the property of ink.

The number of a plurality of adjacent recording permitting pixels constituting a single recording permitting pixel set unit can be 100 or less, in consideration of a grainy effect by a large dot that might be formed by the single recording permitting pixel set unit.

A third exemplary embodiment of the present invention will be described as an example that uses a mask pattern in which the distance between recording permitting pixels is different according to a position in the mask pattern in a direction corresponding to the sub-scanning direction, and the number of levels for the distance is larger than the first and second exemplary embodiments.

The present exemplary embodiment will be described based on an example in which k is 512. 512 nozzles are divided into 16 nozzle groups from a first recording group to a sixteenth recording group, and an image is completed on a unit region by 16 times of recording scanning.

Figure 15:
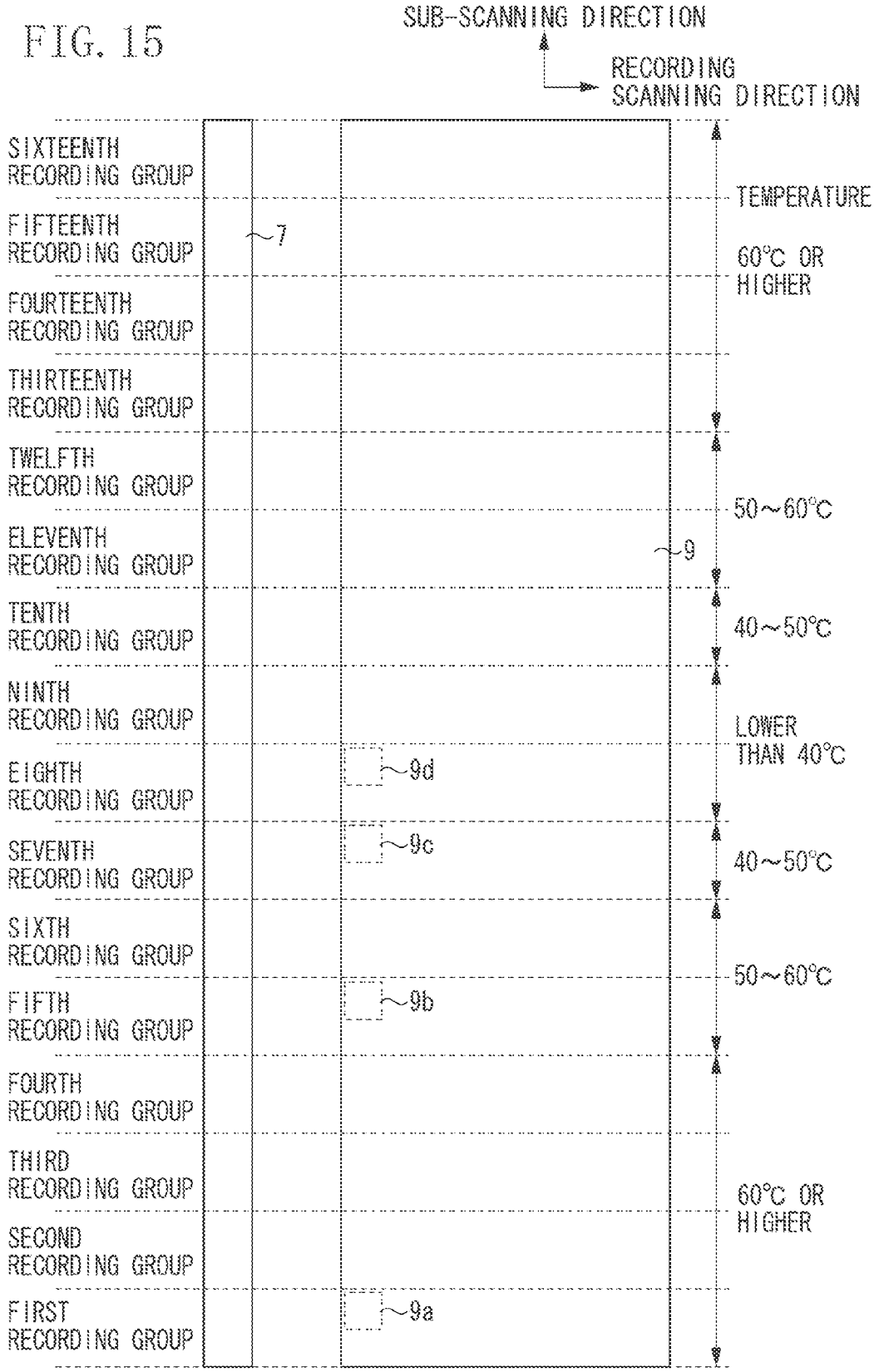
FIG. 15 illustrates a mask pattern according to a third exemplary embodiment of the present invention.

FIG. 15 schematically illustrates an example of a mask pattern employed in the present exemplary embodiment. Further, FIG. 16 schematically illustrates a part of divided patterns that constitute the mask pattern employed in the present exemplary embodiment.

Figure 16:
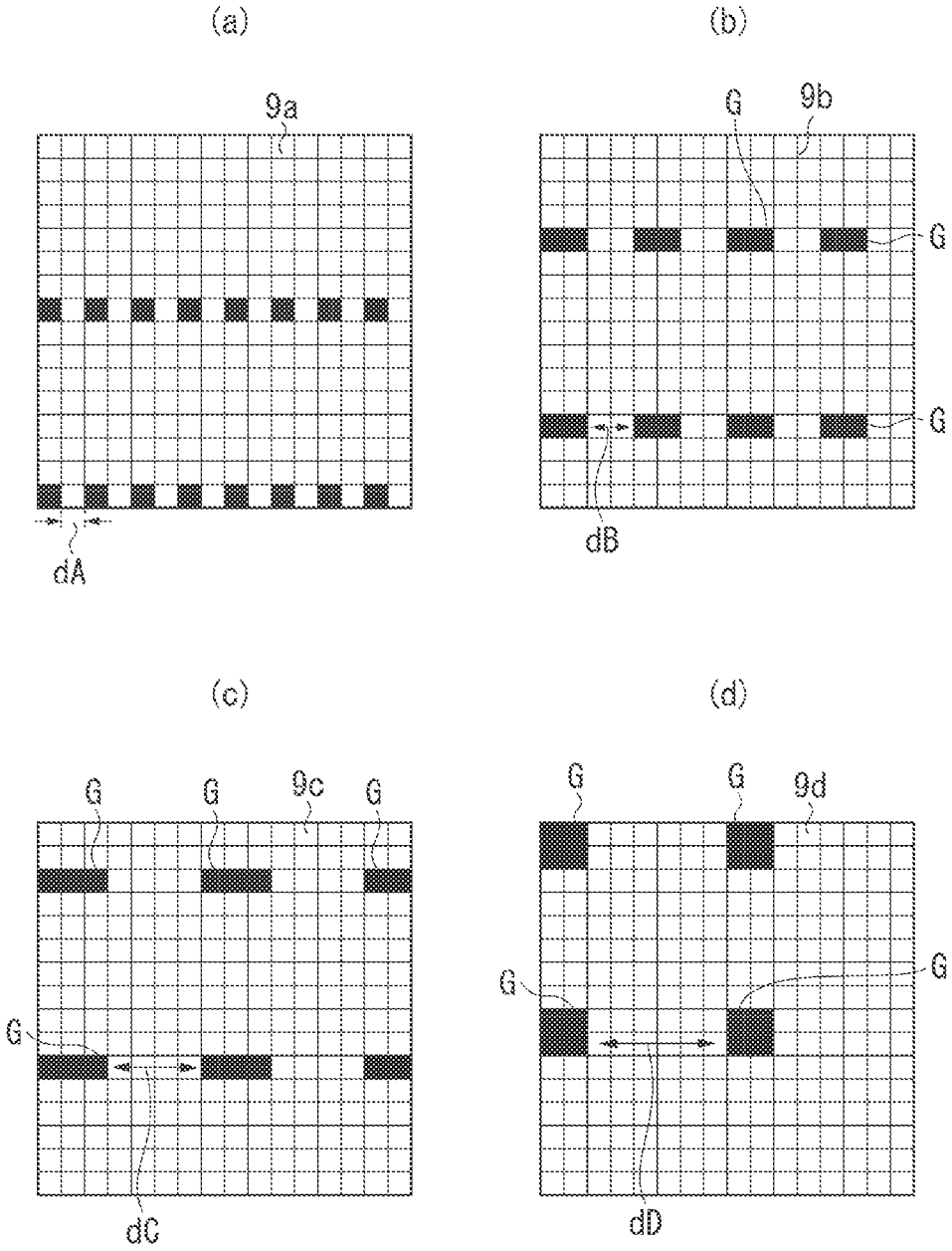
FIG. 16 illustrates divided patterns according to the third exemplary embodiment of the present invention.

The present exemplary embodiment employs a mask pattern 9 constituted by divided patterns 9*a* to 9*d*, illustrated in parts (a), (b), (c), and (d) in FIG. 16 in which recording permitting pixel set units G are separated from each other with distances of different four levels according to a position in the sub-scanning direction, as illustrated in a table illustrated in FIG. 17.

More specifically, a divided pattern 9*d* is used for the eighth and ninth recording groups located at the central portion of the nozzle array, which corresponds to the low-temperature portion of the recording medium 3. In the divided pattern 9*d*, the recording permitting pixel set units G, each of which is constituted by adjacent recording permitting pixels, are separated from each other by a distance dD of 6 pixels (the distance between pixel centers is 7) or more. For simplification of illustration, FIG. 16 illustrates a divided pattern corresponding to a region constituted by 16 pixels×16 pixels, i.e., 256 pixels. An identically configured pattern is employed within the same recording group. Further, a divided pattern 9*c* is used for the seventh and tenth recording groups located closer to the end portions of the nozzle array than the eighth and ninth recording groups. In the divided pattern 9*c*, the recording permitting pixel set units G are separated from each other by a distance dC of 4 pixels (the distance between pixel centers is 5) or more. Further, a divided pattern 9*b* is used for the fifth, sixth, eleventh, and twelfth recording groups located further closer to the nozzle end sides. In the divided pattern 9*b*, the recording permitting pixel set units G are separated from each other by a distance dB of 2 pixels (the distance between pixel centers is 3) or more. Lastly, a divided pattern 9*a* is used for the first to fourth recording groups and the thirteenth to sixteenth recording groups located at the end portions of the nozzle array, which correspond to the high-temperature portions of the recording medium 3. In the divided pattern 9*a*, the recording permitting pixels are separated from each other by a distance dA of 1 pixel (the distance between pixel centers is 2).

Due to this arrangement, the recording permitting pixels can be separated from each other by appropriate distances for each of the region where the temperature is lower than 40° C. when ink droplets are applied onto the recording medium 3, the region where the temperature is 40° C. to 50° C. when ink droplets are applied onto the recording medium 3, the region where the temperature is 50° C. to 60° C. when ink droplets are applied onto the recording medium 3, and the region where the temperature is 60° C. or higher when ink droplets are applied onto the recording medium 3.

According to the present exemplary embodiment, the distance between recording permitting pixels in the mask pattern varies, further closely following smooth distribution of the temperature of the recording medium 3 when ink droplets are applied. Therefore, the present exemplary embodiment is effective in preventing occurrence of a grainy effect due to beading.

The first to third exemplary embodiments of the present invention have been described as the examples that prevent occurrence of beading at the central portion of the recording medium 3 in the sub-scanning direction, and they are derived from the heater configuration described in the descriptions of the first to third exemplary embodiments. However, the present invention is not limited to the examples that employ the setting of increasing the distance between recording permitting pixels for the central portion of a recording medium in the sub-scanning direction.

This beading more frequently occurs at a region where the temperature of a recording medium is relatively low immediately after ink is applied, compared to a region in which the temperature is relatively high. However, the temperature of a recording medium does not necessarily lower at the central portion depending on a heater configuration. For example, if a heater is disposed only at a downstream side in the conveyance direction of a recording medium, it is highly likely that the temperature of the recording medium is low at an upstream side. In this case, the intended effect can be acquired by employing the pattern used at the central portion in the sub-scanning direction, which has been described in the descriptions of the first to third exemplary embodiments, for an end portion at the upstream side in the sub-scanning direction, and employing the pattern used at the both end portions in the sub-scanning direction for an end portion at the downstream side.

Figure 18:
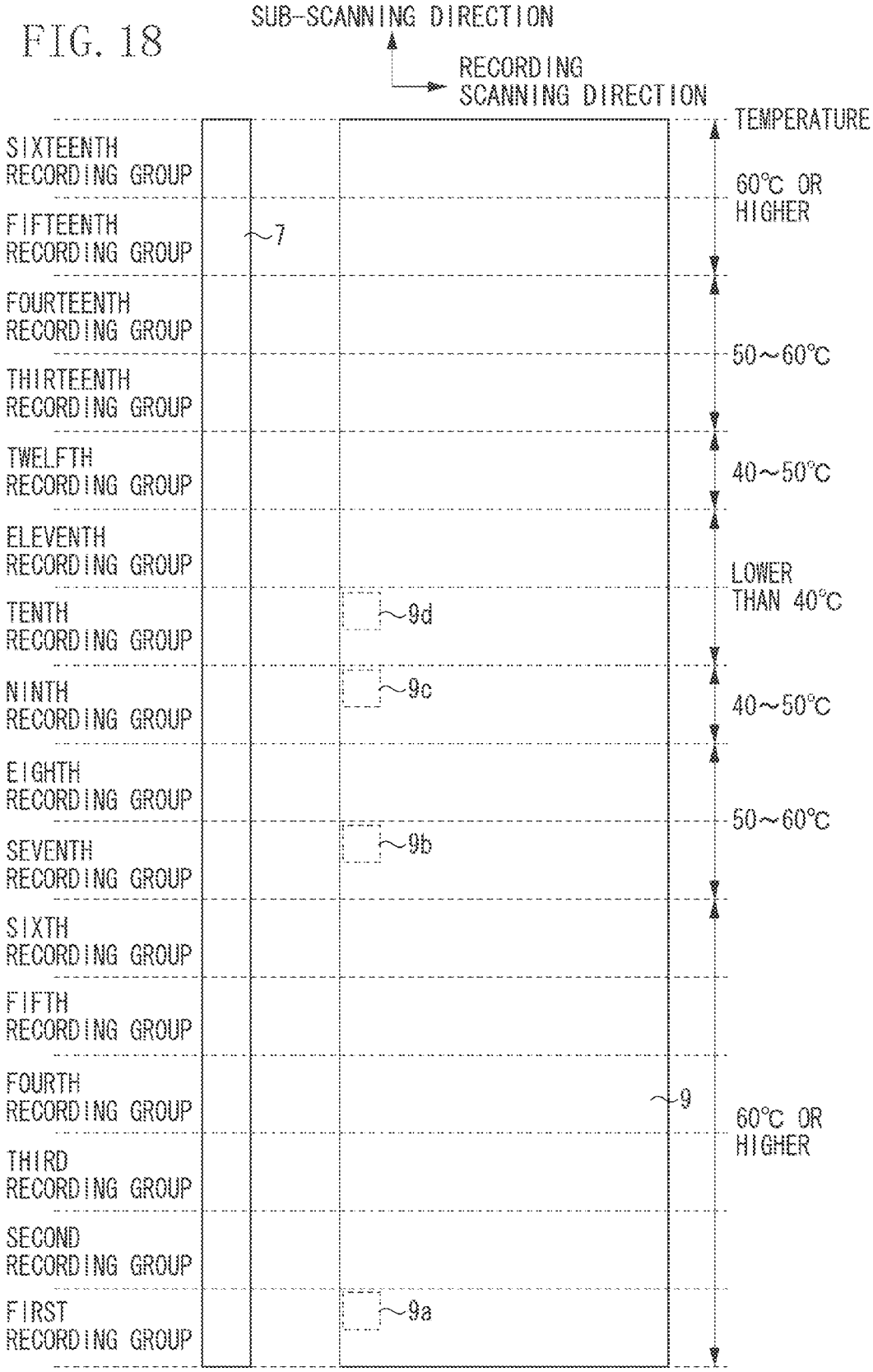
FIG. 18 illustrates a mask pattern according to a fourth exemplary embodiment of the present invention.

FIG. 18 illustrates an example of a mask pattern according to a fourth exemplary embodiment of the present invention.

The present exemplary embodiment has been designed, assuming that a heating device is disposed at the upstream side in the sub-scanning direction. In this case, a region located at a position slightly downstream relative to the central portion in the sub-scanning direction is a region where the temperature of the recording medium 3 is lowest immediately after the ink is applied.

Therefore, in the present exemplary embodiment, the positions of recording permitting pixels are set in such a manner that the region where recording permitting pixel set units are separated from each other by a long distance is located at the downstream side in the sub-scanning direction, compared to the third exemplary embodiment. Further, the positions of recording permitting pixels are set in such a manner that set units having the largest number of adjacent pixels are located at the same position.

According to the present exemplary embodiment, dots can be separated by a long distance at the portion where beading is highly likely to occur due to the degree of lowering in the temperature of the recording medium 3 immediately after the ink is applied, whereby it is possible to further effectively prevent a reduction in the image quality.

As described above, according to the image recording apparatuses of the exemplary embodiments of the present invention, it is possible to acquire a high-quality image by preventing occurrence of density unevenness and granularity derived from beading on a region of a recording medium where the temperature is relatively low after ink is applied.

The present invention can be employed for a wide range of applications in which a low-temperature portion is generated in an image forming region during recording scanning, but is especially effective in an application in which temperature unevenness in an image forming region, i.e., the difference between a maximum value and a minimum value of the temperature in an image forming region on a recording medium is lower than 5° C.

Further, the various exemplary embodiments have been described based on the recording apparatus that uses thermosetting ink, which contains a resin emulsion, and forms a film on the surface of a recording medium to be fixed thereon by receiving heat after ink droplets are applied. However, the present invention is not limited to the recording apparatus that uses such thermosetting ink, and can be effectively employed for all types of recording apparatuses that form an image on a heated recording medium.

Further, the various exemplary embodiments have been described based on the inkjet recording apparatus and recording method of the thermal jet type, which discharges ink with use of bubbling energy generated by heating. However, it is apparent that the present invention is not limited to the inkjet recording apparatus of the thermal jet type, and can be effectively employed for various types of image recording apparatuses such as an inkjet recording apparatus of the piezoelectric type that discharges ink with use of piezoelectric elements.

Further, the various exemplary embodiments have been described based on the recording apparatus and recording method that use the recording medium in which at least a surface portion where liquid is applied is made from a resin so that the recording medium does not absorb water or absorbs little water. However, the recording medium is not limited to such a recording medium, and the present invention can be effectively employed even for a recording apparatus and recording method that use a recording medium exhibiting somewhat low water absorbability. The recording medium can be arbitrarily changed.

Further, the various exemplary embodiments have been described based on the image recording method using the image recording apparatus. However, the present invention can be employed for a wide range of applications such as a data generation apparatus or data generation method that generates data for performing the image recording methods described in the descriptions of the various exemplary embodiments, and a configuration in which a program is prepared separately from the recording apparatus or is provided in a part of the recording apparatus.

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment (s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to the image recording apparatuses of the exemplary embodiments of the present invention, it is possible to prevent occurrence of density unevenness and granularity due to the temperature distribution in a recording medium to acquire a high-quality image, by increasing the distance between ink droplets on a region where the temperature of the recording medium is lower than a predetermined temperature after ink is applied onto the recording medium, compared to the distance between ink droplets on a region where the temperature is higher than the predetermined temperature.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-131301 filed Jun. 8, 2012, which is hereby incorporated by reference herein in its entirety.

What is claimed is:

1. An image recording apparatus configured to record an image by discharging ink onto a recording medium based on recording data, the image recording apparatus comprising:

a discharge head including a discharge port array in which a plurality of discharge ports configured to discharge the ink is arranged in an arrangement direction;

a heating unit configured to heat the recording medium;

a scanning unit configured to cause the discharge head to relatively scan a unit region on the recording medium a plurality of times in a scanning direction intersecting with the arrangement direction in such a manner that respective different divided portions, among a plurality of divided portions formed by dividing the discharge port array, face the unit region by the respective plurality of times of scanning; and a generation unit configured to generate recording data to be used in the respective times of scanning of the discharge head on the unit region by employing a divided pattern, which corresponds to each of the different portions of the discharge port array and includes an arrangement of recording permitting pixels that determine permission of recording onto the unit region and recording non-permitting pixels that determine nonpermission of recording onto the unit region, for image data corresponding to the unit region, wherein an average of distances between each of the recording permitting pixels and the recording permitting pixel located at a close position thereto in the divided pattern corresponding to a region that has a first temperature when the discharged ink is applied onto the recording medium is longer than an average of distances between each of the recording permitting pixels and the recording permitting pixel located at a close position thereto in the divided pattern corresponding to a region that has a second temperature higher than the first temperature when the discharged ink is applied onto the recording medium.

2. The image recording apparatus according to claim 1, wherein a ratio of the recording permitting pixels to the recording non-permitting pixels in the divided pattern corresponding to the region in the unit region that has the first temperature when the discharged ink is applied onto the recording medium is approximately equal to a ratio of the recording permitting pixels to the recording non-permitting pixels in the divided pattern corresponding to the region in the unit region that has the second temperature when the discharged ink is applied onto the recording medium.

3. The image recording apparatus according to claim 2, further comprising a platen configured to support the recording medium, wherein the heating unit is disposed at a position opposite the platen across the discharge head.

4. An image recording apparatus configured to record an image by discharging ink onto a recording medium based on recording data, the image recording apparatus comprising:

a discharge head including a discharge port array in which a plurality of discharge ports configured to discharge the ink is arranged in an arrangement direction;

a heating unit configured to heat the recording medium;

a scanning unit configured to cause the discharge head to relatively scan a unit region on the recording medium a plurality of times in a scanning direction intersecting with the arrangement direction in such a manner that respective different divided portions, among a plurality of divided portions formed by dividing the discharge port array, face the unit region by the respective plurality of times of scanning; and a generation unit configured to generate recording data to be used in the respective times of scanning of the discharge head on the unit region by employing a divided pattern, which corresponds to each of the different portions of the discharge port array and includes an arrangement of recording permitting pixels that determine permission of recording onto the unit region and recording non-permitting pixels that determine nonpermission of recording onto the unit region, for image data corresponding to the unit region, wherein an average of numbers of the recording permitting pixels in recording permitting pixel set units, each of which is one of a recording permitting pixel group constituted by a series of the plurality of recording permitting pixels located adjacent to each other, and a recording permitting pixel without another recording permitting pixel adjacent thereto, in the divided pattern corresponding to a region in the unit region that has a first temperature when the discharged ink is applied onto the recording medium is larger than an average of numbers of the recording permitting pixels in the recording permitting pixel set units in the divided pattern corresponding to a region in the unit region that has a second temperature higher than the first temperature when the discharged ink is applied onto the recording medium, and wherein an average of distances between each of the recording permitting pixel set units and the recording permitting pixel set unit located at a close position thereto in the divided pattern corresponding to the region that has the first temperature when the discharged ink is applied onto the recording medium is longer than an average of distances between each of the recording permitting pixel set units and the recording permitting pixel set unit located at a close position thereto in the divided pattern corresponding to the region that has the second temperature when the discharged ink is applied onto the recording medium.

5. The image recording apparatus according to claim 4, wherein a ratio of the recording permitting pixels to the recording non-permitting pixels in the divided pattern corresponding to the region in the unit region that has the first temperature when the discharged ink is applied onto the recording medium is approximately equal to a ratio of the recording permitting pixels to the recording non-permitting pixels in the divided pattern corresponding to the region in the unit region that has the second temperature when the discharged ink is applied onto the recording medium.

6. The image recording apparatus according to claim 5, further comprising a platen configured to support the recording medium, wherein the heating unit is disposed at a position opposite the platen across the discharge head.

7. The image recording apparatus according to claim 6, wherein the heating unit is disposed at a position corresponding to the discharge head in the arrangement direction.

8. The image recording apparatus according to claim 4, wherein the ink contains a resin emulsion.

9. The image recording apparatus according to claim 4, wherein the recording medium includes a layer made from vinyl chloride on a base material.

10. An image recording apparatus configured to record an image by discharging ink onto a recording medium based on recording data, the image recording apparatus comprising:

a discharge head including a discharge port array in which a plurality of discharge ports configured to discharge the ink is arranged in an arrangement direction;

a heating unit configured to heat the recording medium;

a scanning unit configured to cause the discharge head to relatively scan a unit region on the recording medium a plurality of times in a scanning direction intersecting with the arrangement direction in such a manner that respective different divided portions, among a plurality of divided portions formed by dividing the discharge port array, face the unit region by the respective plurality of times of scanning; and a generation unit configured to generate recording data to be used in the respective times of scanning of the discharge head on the unit region by employing a divided pattern, which corresponds to each of the different portions of the discharge port array and includes an arrangement of recording permitting pixels that determine permission of recording onto the unit region and recording non-permitting pixels that determine nonpermission of recording onto the unit region, for image data corresponding to the unit region, wherein an average of distances between each of the recording permitting pixels and the recording permitting pixel located at a close position thereto in the divided pattern employed for a predetermined number of discharge ports arranged at a first position of the discharge port array in the arrangement direction is longer than an average of distances between each of the recording permitting pixels and the recording permitting pixel located at a close position thereto in the divided pattern employed for a predetermined number of discharge ports disposed at a second position of the discharge port array located at an end side relative to the first position in the arrangement direction.

11. The image recording apparatus according to claim 10, wherein a ratio of the recording permitting pixels to the recording non-permitting pixels in the divided pattern employed for the predetermined number of discharge ports arranged at the first position is approximately equal to a ratio of the recording permitting pixels to the recording non-permitting pixels in the divided pattern employed for the predetermined number of discharge ports arranged at the second position.

12. The image recording apparatus according to claim 11, further comprising a platen configured to support the recording medium, wherein the heating unit is disposed at a position opposite the platen across the discharge head.

13. An image recording apparatus configured to record an image by discharging ink onto a recording medium based on recording data, the image recording apparatus comprising:

a discharge head including a discharge port array in which a plurality of discharge ports configured to discharge the ink is arranged in an arrangement direction;

a heating unit configured to heat the recording medium;

a scanning unit configured to cause the discharge head to relatively scan a unit region on the recording medium a plurality of times in a scanning direction intersecting with the arrangement direction in such a manner that respective different divided portions, among a plurality of divided portions formed by dividing the discharge port array, face the unit region by the respective plurality of times of scanning; and a generation unit configured to generate recording data to be used in the respective times of scanning of the discharge head on the unit region by employing a divided pattern, which corresponds to each of the different portions of the discharge port array and includes an arrangement of recording permitting pixels that determine permission of recording onto the unit region and recording non-permitting pixels that determine nonpermission of recording onto the unit region, for image data corresponding to the unit region, wherein an average of numbers of the recording permitting pixels in recording permitting pixel set units, each of which is one of a recording permitting pixel group constituted by a series of the plurality of recording permitting pixels located adjacent to each other, and a recording permitting pixel without another recording permitting pixel adjacent thereto, in the divided pattern employed for a predetermined number of discharge ports arranged at a first position of the discharge port array in the arrangement direction is larger than an average of numbers of the recording permitting pixels in the recording permitting pixel set units in the divided pattern employed for a predetermined number of discharge ports arranged at a second position of the discharge port array located at an end side relative to the first position in the arrangement direction, and wherein an average of distances between each of the recording permitting pixel set units and the recording permitting pixel set unit located at a close position thereto in the divided pattern employed for the predetermined number of discharge ports arranged at the first position is longer than an average of distances between each of the recording permitting pixel set units and the recording permitting pixel set unit located at a close position thereto in the divided pattern employed for the predetermined number of discharge ports arranged at the second position.

14. The image recording apparatus according to claim 13, wherein a ratio of the recording permitting pixels to the recording non-permitting pixels in the divided pattern employed for the predetermined number of discharge ports arranged at the first position is approximately equal to a ratio of the recording permitting pixels to the recording non-permitting pixels in the divided pattern employed for the predetermined number of discharge ports arranged at the second position.

15. The image recording apparatus according to claim 14, further comprising a platen configured to support the recording medium, wherein the heating unit is disposed at a position opposite the platen across the discharge head.

16. The image recording apparatus according to claim 15, wherein the heating unit is disposed at a position corresponding to the discharge head in the arrangement direction.

17. The image recording apparatus according to claim 13, wherein the ink contains a resin emulsion.

18. The image recording apparatus according to claim 13, wherein the recording medium includes a layer made from vinyl chloride on a base material.

19. An image recording method for recording an image by discharging ink onto a recording medium based on recording data with use of a discharge head including a discharge port array in which a plurality of discharge ports configured to discharge the ink is arranged in an arrangement direction, the image recording method comprising:

heating the recording medium;

causing the discharge head to relatively scan a unit region on the recording medium a plurality of times in a scanning direction intersecting with the arrangement direction in such a manner that respective different divided portions, among a plurality of divided portions formed by dividing the discharge port array, face the unit region by the respective plurality of times of scanning; and generating recording data to be used in the respective times of scanning of the discharge head on the unit region by employing a divided pattern, which corresponds to each of the different portions of the discharge port array and includes an arrangement of recording permitting pixels that determine permission of recording onto the unit region and recording non-permitting pixels that determine nonpermission of recording onto the unit region, for image data corresponding to the unit region, wherein an average of numbers of the recording permitting pixels in recording permitting pixel set units, each of which is one of a recording permitting pixel group constituted by a series of the plurality of recording permitting pixels located adjacent to each other, and a recording permitting pixel without another recording permitting pixel adjacent thereto, in the divided pattern corresponding to a region in the unit region that has a first temperature when the discharged ink is applied onto the recording medium is larger than an average of numbers of the recording permitting pixels in the recording permitting pixel set units in the divided pattern corresponding to a region in the unit region that has a second temperature higher than the first temperature when the discharged ink is applied onto the recording medium, and wherein an average of distances between each of the recording permitting pixel set units and the recording permitting pixel set unit located at a close position thereto in the divided pattern corresponding to the region that has the first temperature when the discharged ink is applied onto the recording medium is longer than an average of distances between each of the recording permitting pixel set units and the recording permitting pixel set unit located at a close position thereto in the divided pattern corresponding to the region that has the second temperature when the discharged ink is applied onto the recording medium.

20. An image recording method for recording an image by discharging ink onto a recording medium based on recording data with use of a discharge head including a discharge port array in which a plurality of discharge ports configured to discharge the ink is arranged in an arrangement direction, the image recording method comprising:

heating the recording medium;

causing the discharge head to relatively scan a unit region on the recording medium a plurality of times in a scanning direction intersecting with the arrangement direction in such a manner that respective different divided portions, among a plurality of divided portions formed by dividing the discharge port array, face the unit region by the respective plurality of times of scanning; and generating recording data to be used in the respective times of scanning of the discharge head on the unit region by employing the divided pattern, which corresponds to each of the different portions of the discharge port array and includes an arrangement of recording permitting pixels that determine permission of recording onto the unit region and recording non-permitting pixels that determine nonpermission of recording onto the unit region, for image data corresponding to the unit region, wherein an average of numbers of the recording permitting pixels in recording permitting pixel set units, each of which is one of a recording permitting pixel group constituted by a series of the plurality of recording permitting pixels located adjacent to each other, and a recording permitting pixel without another recording permitting pixel adjacent thereto, in the divided pattern employed for a predetermined number of discharge ports arranged at a first position of the discharge port array in the arrangement direction is larger than an average of numbers of the recording permitting pixels in the recording permitting pixel set units in the divided pattern employed for a predetermined number of discharge ports arranged at a second position of the discharge port array located at an end side relative to the first position in the arrangement direction, and wherein an average of distances between each of the recording permitting pixel set units and the recording permitting pixel set unit located at a close position thereto in the divided pattern employed for the predetermined number of discharge ports arranged at the first position is longer than an average of distances between each of the recording permitting pixel set units and the recording permitting pixel set unit located at a close position thereto in the divided pattern employed for the predetermined number of discharge ports arranged at the second position.

* * * * *